US008231148B2

(12) United States Patent
Van Der Kooij

(10) Patent No.: US 8,231,148 B2
(45) Date of Patent: Jul. 31, 2012

(54) ASSEMBLY COMPRISING A MOVEABLE PANEL, FOR EXAMPLE A SWINGING DOOR OR WINDOW, AND A LATCHING MECHANISM THEREOF

(76) Inventor: Johannes Jacob Hans Willem Van Der Kooij, Arnhem (NL)

( * ) Notice: Subject to any disclaimer, the term of this patent is extended or adjusted under 35 U.S.C. 154(b) by 1221 days.

(21) Appl. No.: 11/985,060

(22) Filed: Nov. 13, 2007

(65) Prior Publication Data

US 2008/0150303 A1 Jun. 26, 2008

(30) Foreign Application Priority Data

Nov. 13, 2006 (EP) ..... 06077010

(51) Int. Cl.
*E05C 1/00* (2006.01)

(52) U.S. Cl. ..... 292/37; 292/33; 292/159

(58) Field of Classification Search ..... 292/37, 292/74, 65, 159, DIG. 21, 16, 140, 165, 32, 292/33, 42; 70/108, 110, 118, 120
See application file for complete search history.

(56) References Cited

U.S. PATENT DOCUMENTS 1,550,532 A * 8/1925 French ..... 292/37
1,646,674 A * 10/1927 Angelillo ..... 70/109
2,729,089 A * 1/1956 Pelcin ..... 70/151 R
3,888,046 A 6/1975 Meisterheim
3,953,061 A * 4/1976 Hansen et al. ..... 292/5
4,665,727 A * 5/1987 Uyeda ..... 70/279.1
4,926,664 A * 5/1990 Gartner et al. ..... 70/119
5,697,654 A 12/1997 MacDonald

FOREIGN PATENT DOCUMENTS

| | | |
|---|---|---|
| EP | 1219769 | 7/2002 |
| FR | 2451437 | 10/1980 |
| FR | 2742184 | 6/1997 |
| GB | 2158869 | 11/1985 |

* cited by examiner

*Primary Examiner* — Carlos Lugo
*Assistant Examiner* — Mark Williams
(74) *Attorney, Agent, or Firm* — Weingarten, Schurgin, Gagnebin & Lebovici LLP

(57) ABSTRACT

An assembly comprising a moveable panel, for example a swinging door or window, and a latching mechanism (10) for latching the panel (1) to at least one nearby element (2) in case the panel (1) is in a first, particularly closed, position, the latching mechanism (10) being provided with at least one first latch (11) and with operating means (13) for moving the latch (11) out of a first lateral side of the panel (1) from a panel-releasing position to a panel-latching position and vice-versa, wherein the at least one first latch (11) is dimensioned such that it extends along substantially the entire first lateral side of the panel (1).

15 Claims, 21 Drawing Sheets

Figure 1A:
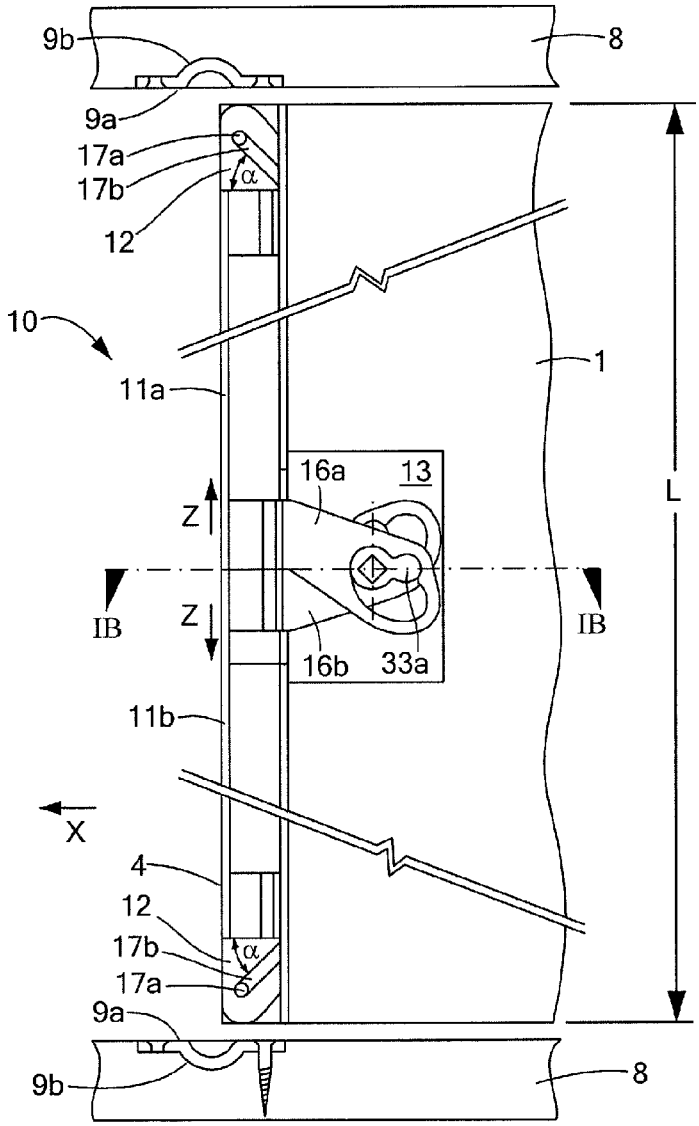

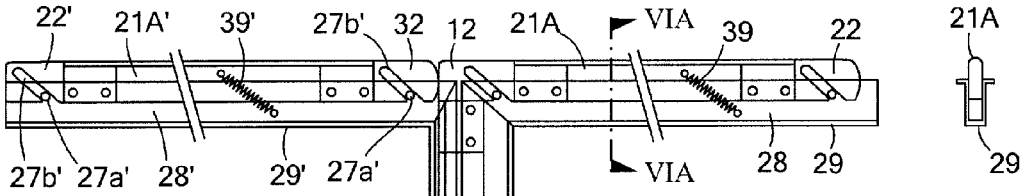
FIG. 6A
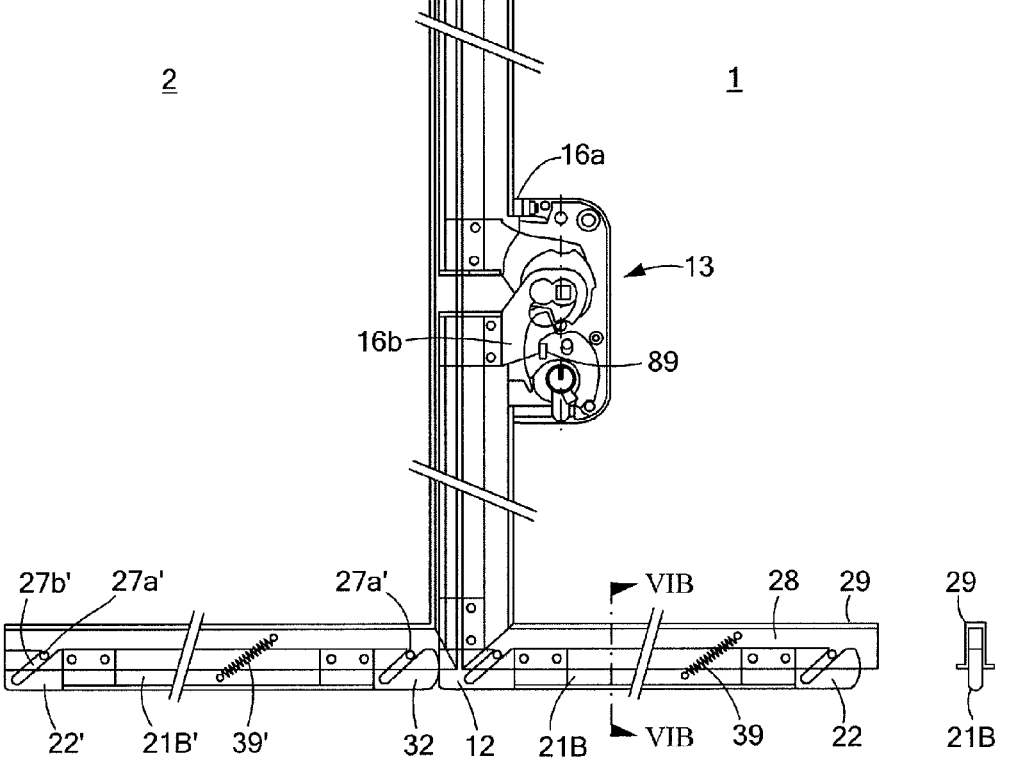
FIG. 6B
FIG. 5

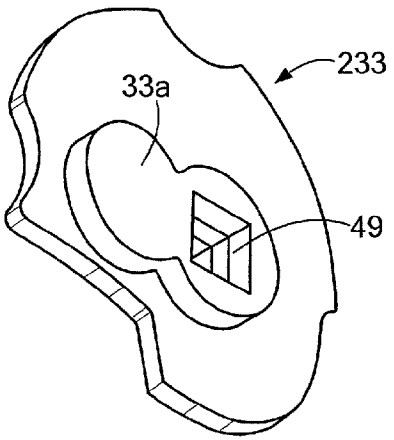
FIG. 16A
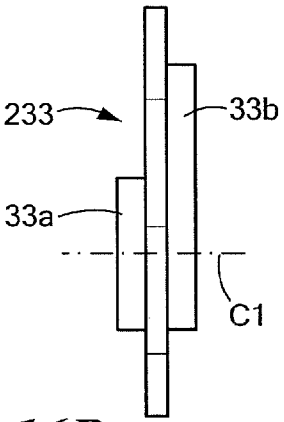
FIG. 16B
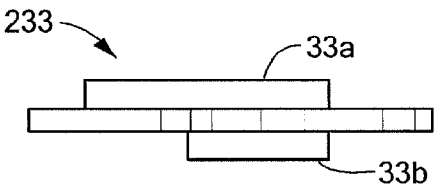
FIG. 16C
FIG. 16D
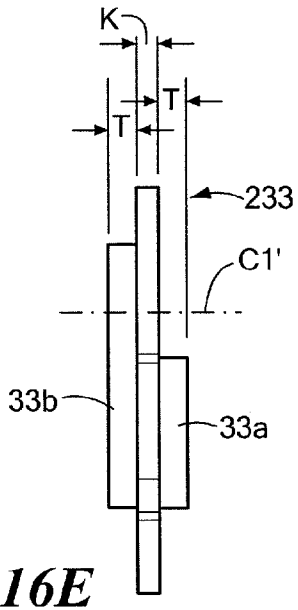
FIG. 16E
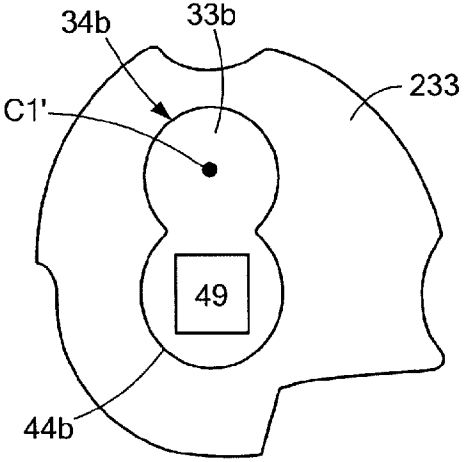
FIG. 16F

ASSEMBLY COMPRISING A MOVEABLE PANEL, FOR EXAMPLE A SWINGING DOOR OR WINDOW, AND A LATCHING MECHANISM THEREOF

This application claims priority to European application No. 06 077010.4 filed Nov. 13, 2006.

The invention relates to an assembly comprising a moveable panel, for example a swinging door or window, and a latching mechanism for latching the panel to at least one nearby element in case the panel is in a first, particularly closed, position, the latching mechanism being provided with at least one first latch and with operating means for moving the latch out of a first lateral side of the panel from a panel-releasing position to a panel-latching position and vice-versa Such an assembly is commonly known from the prior art and comprises a single latch mechanism, for example to latch a door to a doorpost. A disadvantage of this prior art latching mechanism is that it does not provide a strong latching. Besides, the single latch mechanism can not provide a good fire resistance to the assembly.

Another assembly is known from the prior art and comprises an espagnolet type bolt mechanism. In the espagnolet type assembly, two swinging doors (or windows) are latched to a frame using elongated rods, that are translatable up and down into a respective doorframe (or window frame) and vice-versa. The espagnolet type assembly also has various disadvantages. Particularly, the latching provided by the known espagnolet type mechanism is relatively weak and not very burglar-proof. Besides, the espagnolet type latch is not very durable, takes in relatively much space, and can not provide a good fire resistance.

The present invention aims to alleviate at least part of the mentioned problems. Particularly, the invention aims to provide an improves assembly that can provide a durable latching.

According to an embodiment of the invention, the assembly according to the preamble of claim 1 is characterised in that the at least one first latch is dimensioned such that it extends along substantially the entire first lateral side of the panel.

Thus, a durable, sturdy and burglar proof latching can be provided by the latching mechanism. Also, an advantage is that the first latch can provide a relatively good fire-resistance, for example to firmly hold a panel in its first position to prevent thermal distortion of the panel, particularly in the case that the panel is in a closest position to close a respective frame opening (for example door-opening or window-opening), to prevent a further spreading of a fire.

Yet another advantage is that the first latch can serve to substantially close or seal a slit, extending alongside the panel when the panel is in its first position. Thus, the latch can provide an air draft prevention means in a simple manner. For example, the latch can provide good isolation (for example thermal and/or sound isolation) between the panel and an adjoining construction or element.

The present invention has various applications, as will be appreciated by the skilled person. In an advantageous embodiment, the panel of the assembly can be a door or window of a building. Alternatively, for example, the assembly can relate to furniture, for example in case the panel is a panel of a storage compartment or a cabinet. In a preferred embodiment, the panel can be a swivelling or swinging panel, for example a swinging door, which is hingingly connected at one side to a suitable frame member or another element.

According to an advantageous embodiment, the first lateral side of the panel is provided with at least one longitudinal groove which receives the at least one first latch when that latch is in the respective panel-releasing position. For example, the first latch can be substantially retracted into the panel in the case that no latching is required. Via operating the respective operating means, the latch can be moved at least partly away from the panel towards the nearby element for latching the panel to that element. In this way, the latch can be simply mounted into the panel, particularly into the first lateral side thereof, so that a front side or back side of the panel can be kept intact. Preferably, the longitudinal groove is provided with a latch receiving profile, for example a U-shaped metal or steel profile. The profile can act as a latch holder and can guide the first latch to respective operating positions.

In a further embodiment, the mentioned at least one nearby element can comprise a latching aperture to receive the at least one first latch when that latch is in the latching position and the first panel is in its first position, wherein the at least one nearby element comprises one or both of:

- a frame or framework, or part thereof; and
- a second moveable panel arranged with a lateral side opposite the first lateral side of the first moveable panel when the panels are in respective first positions.

For example, the present assembly can include a single panel that is moveably coupled to a respective frame. In an alternative embodiment, a frame is provided with two panels, or more. In the latter case, at least one latching mechanism can be provided to latch the two panels to each other, particularly along opposite lateral sides of the panels, in which case the at least one first latch can seal a slit extending between the panels. Moreover, in a preferred embodiment, the at least one first latch also latches the two panels to the respective (door or window) frame, for example at upper and lower sides of the panels.

In a further embodiment, the latching mechanism comprises guiding means to guide each first latch from a panel-releasing position to a panel-latching position and vice-versa. The guiding means can preferably be configured to guide an end part of each first latch towards a latching position wherein the end part of the latch reaches away from the panel in a first direction that is perpendicular to the first lateral side of the panel and also in a second direction that is parallel to the first lateral side of the panel.

For example, the end part of the first latch can serve to cooperate with several nearby elements, for example to a nearby horizontal frame part and to a nearby vertical frame part in the case the panel is to be latched to a respective frame only, or, in an alternative embodiment, to a nearby horizontal frame part and to a nearby panel part of another moveable panel in the case the latching mechanism is be provided to latch the two panels to each other as well.

In yet a further embodiment, the assembly is characterised by two first latches, the two latches being aligned with respect to each other, and being moveable over a certain distance away from each other, in a direction parallel to the first lateral side of the panel, by the operating means when these latches are moved to the latching positions, wherein the overall length of the two first latches is preferably equal to the length of the first lateral side of the panel.

Besides, advantageously, the latching mechanism can comprise at least one second latch that is moveable from a panel-releasing position to a panel-latching position and vice-versa, wherein the at least one second latch extends along a second lateral side of the panel, wherein the at least one first latch and the at least one second latch cooperate to move the at least second latch upon movement of the at least first latch. For example, a second latch can extend in a substantial perpendicular direction with respect to a longitudinal direction of the first latches. In this way, the panel can be latched to respective nearby elements along various sides, to provide a very durable, fire-resistant panel latching.

The operating means can be configured in various ways, as will be appreciated by the skilled person. Several advantageous embodiments of the operating means have been described in the dependent claims and will also be explained below, with reference to the drawings.

The present invention can be marketed in various ways. For example, the assembly can be provided in an assembled or at least part disassembled condition. Also, the assembly can be of a modular configuration. Besides, there can be provided a separate latching mechanism of the assembly according to any of the claims 1-12, wherein the latching mechanism can be mounted to a panel (an for example the nearly element) to provide an assembly according to the invention.

Figure 1B:
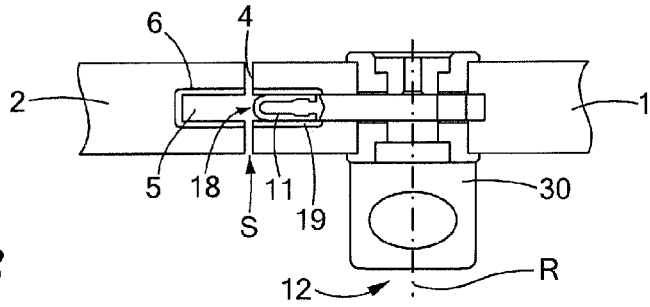
Figure 2A:
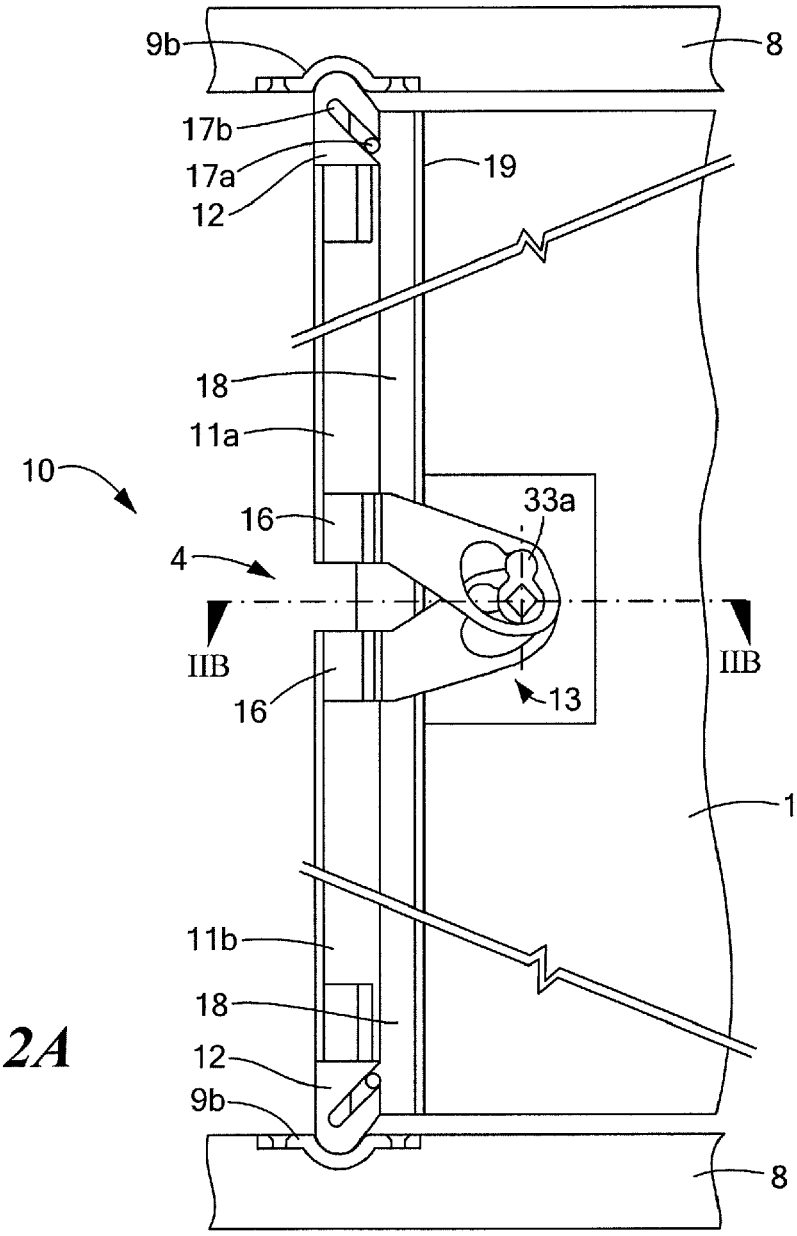
Figure 2B:
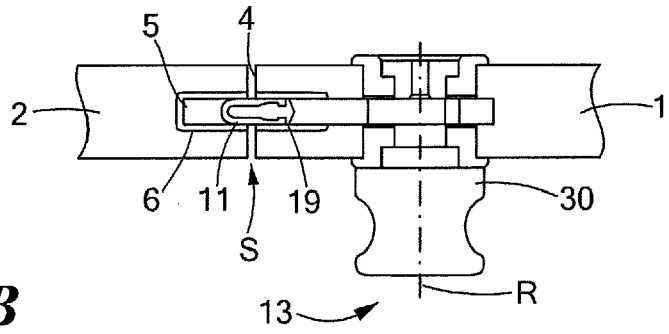
Figure 3A:
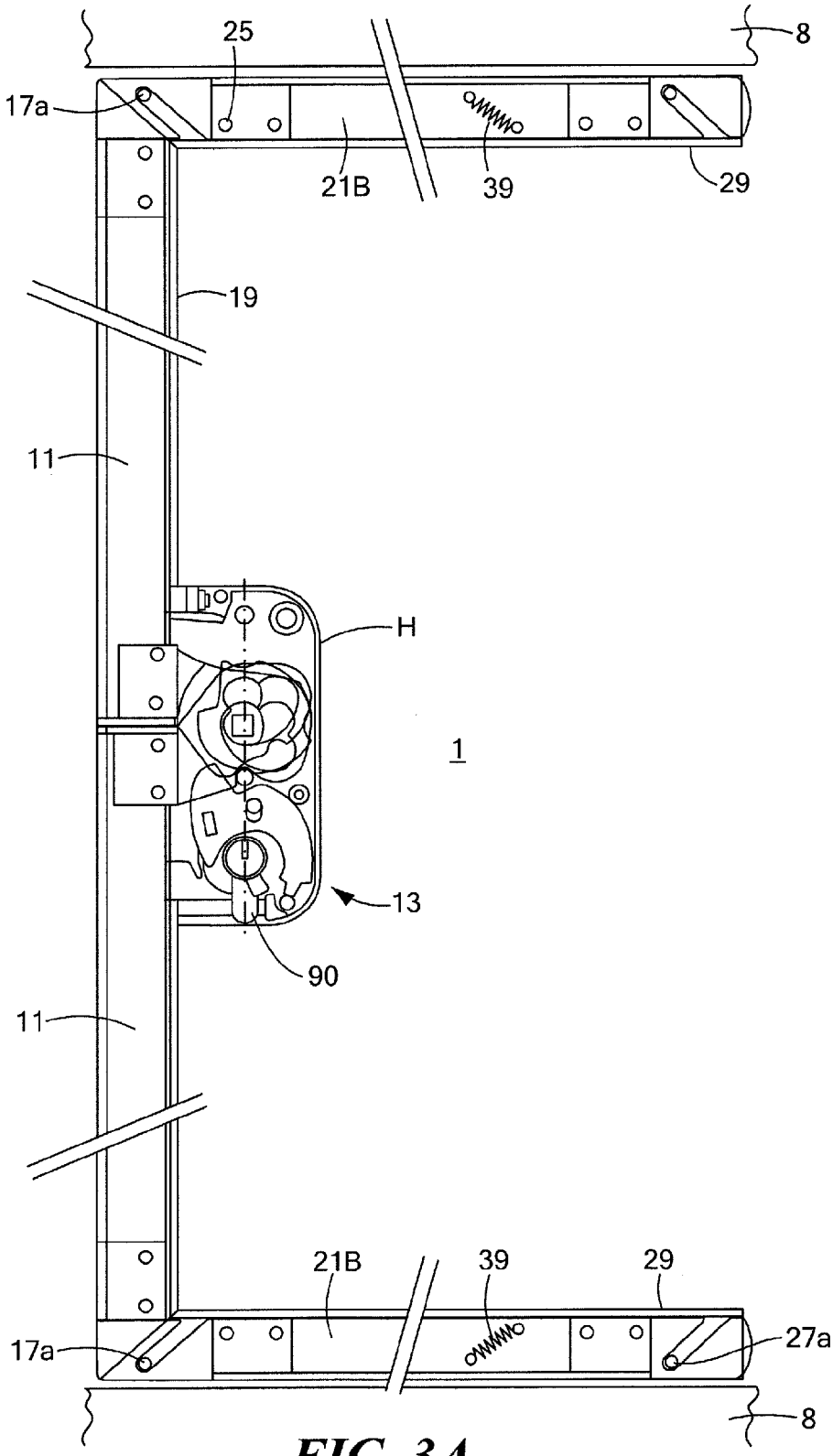
Figure 3B:
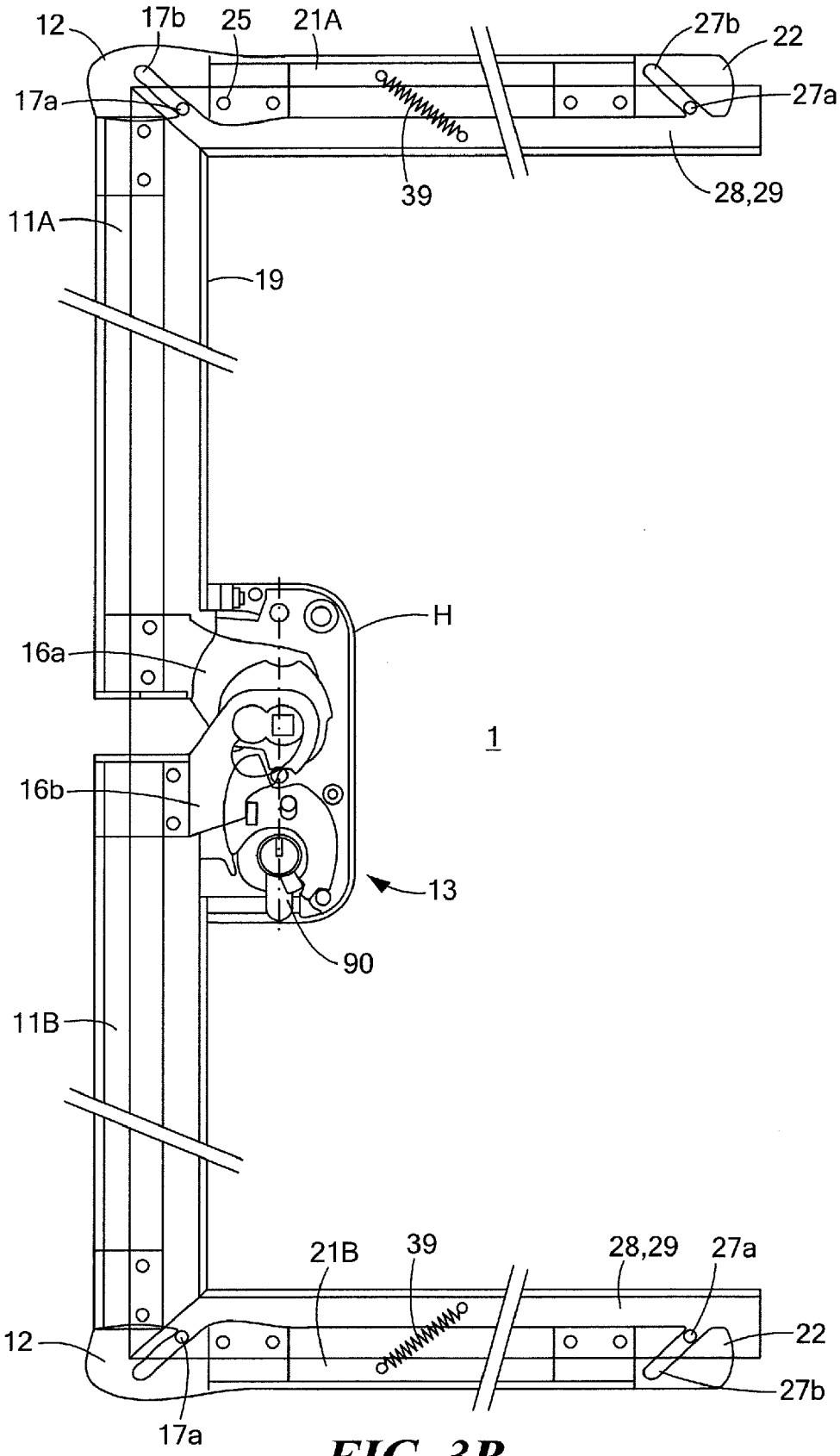
Figure 4:
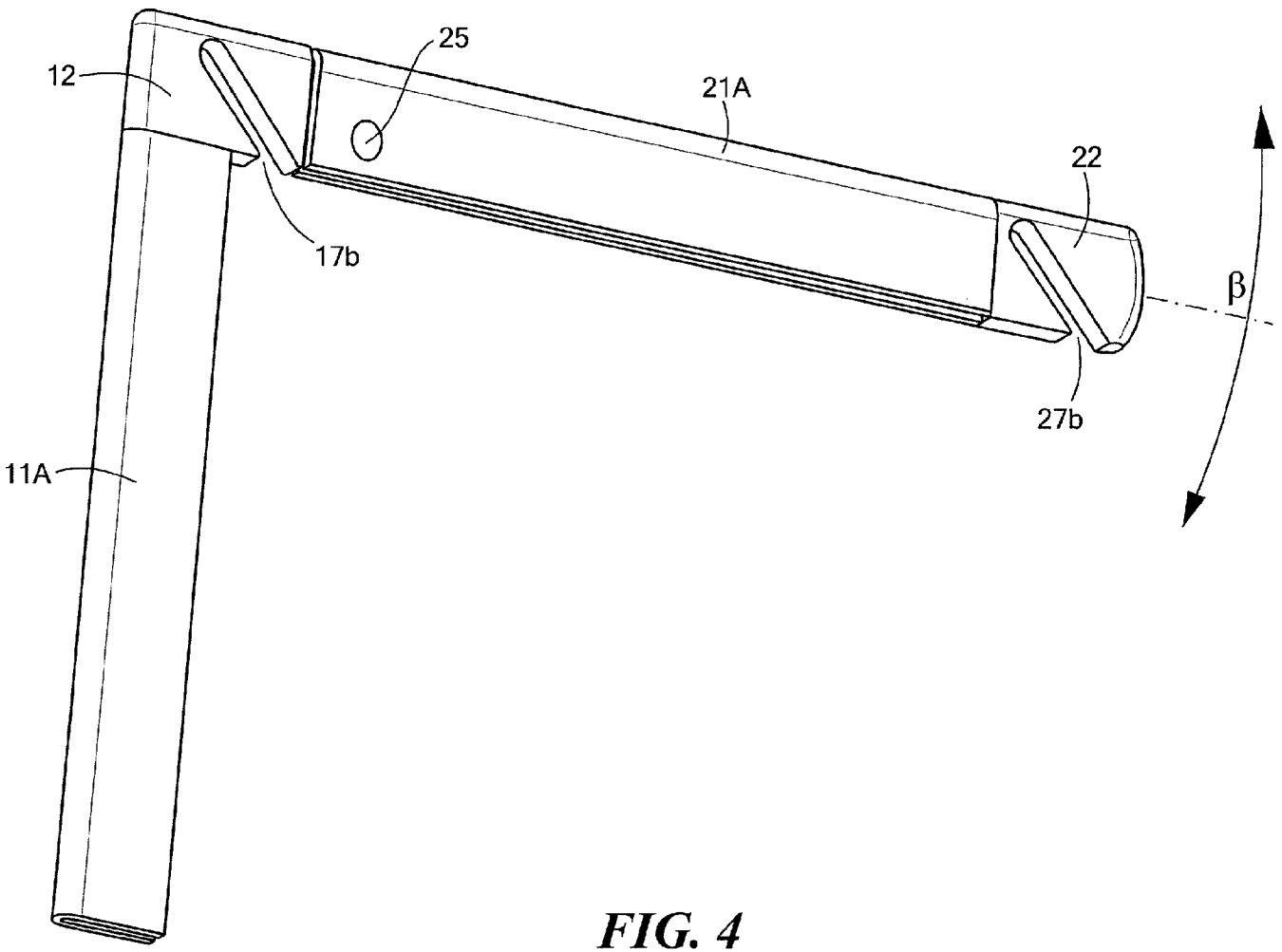
Figure 7:
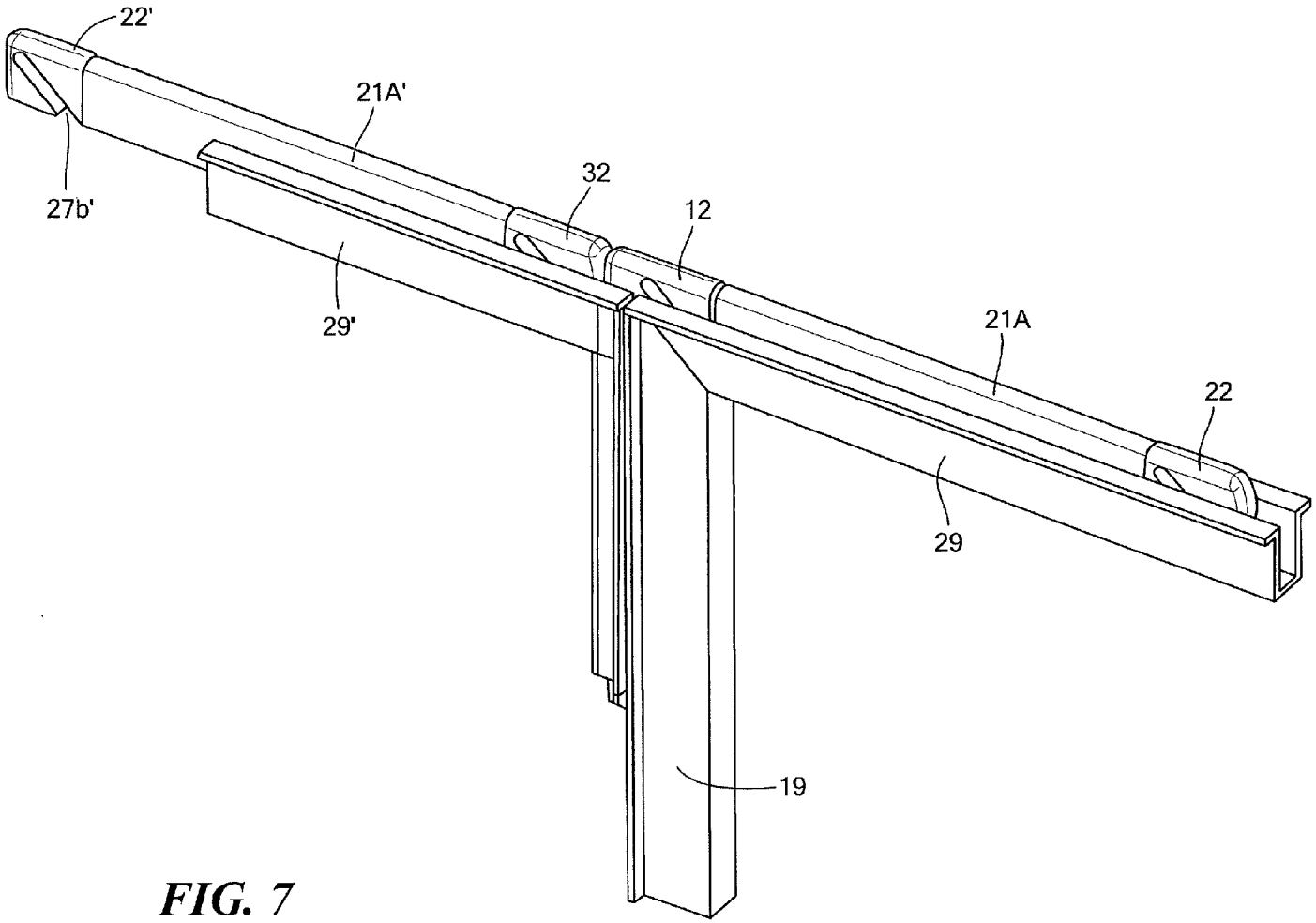
Figure 8A:
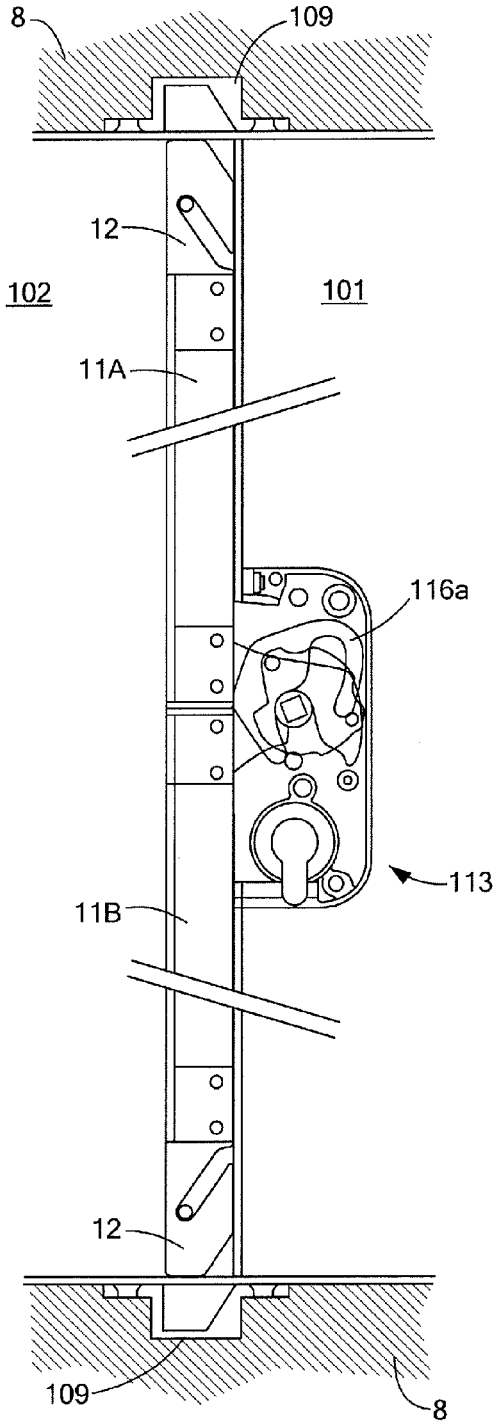
Figure 8B:
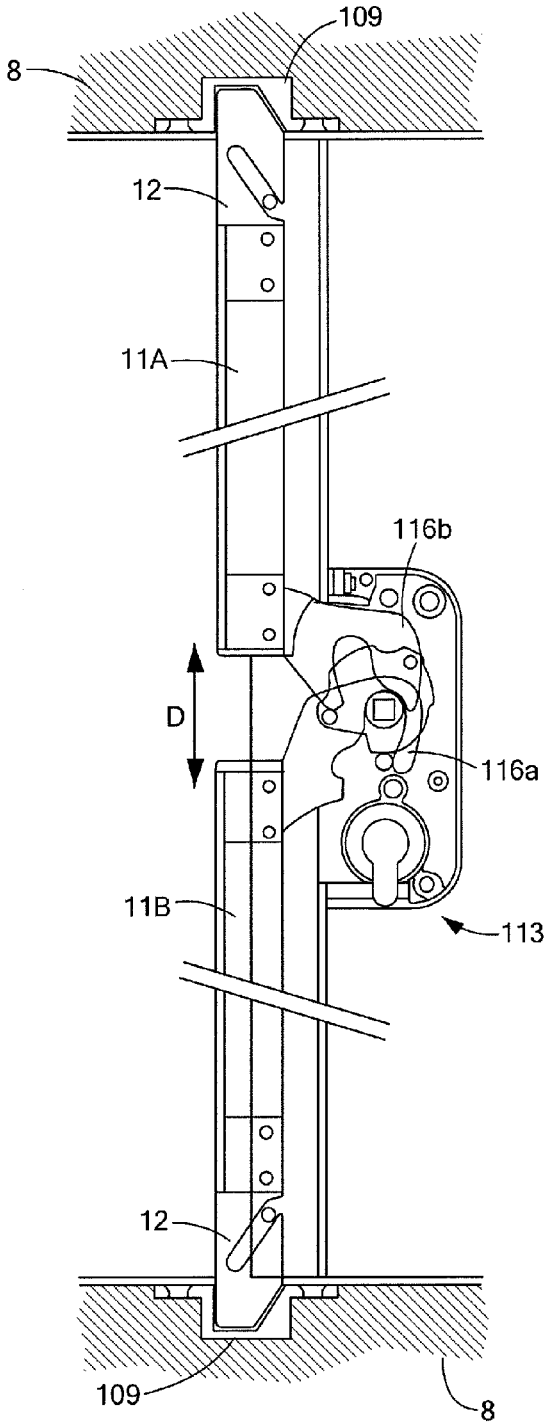
Figure 9:
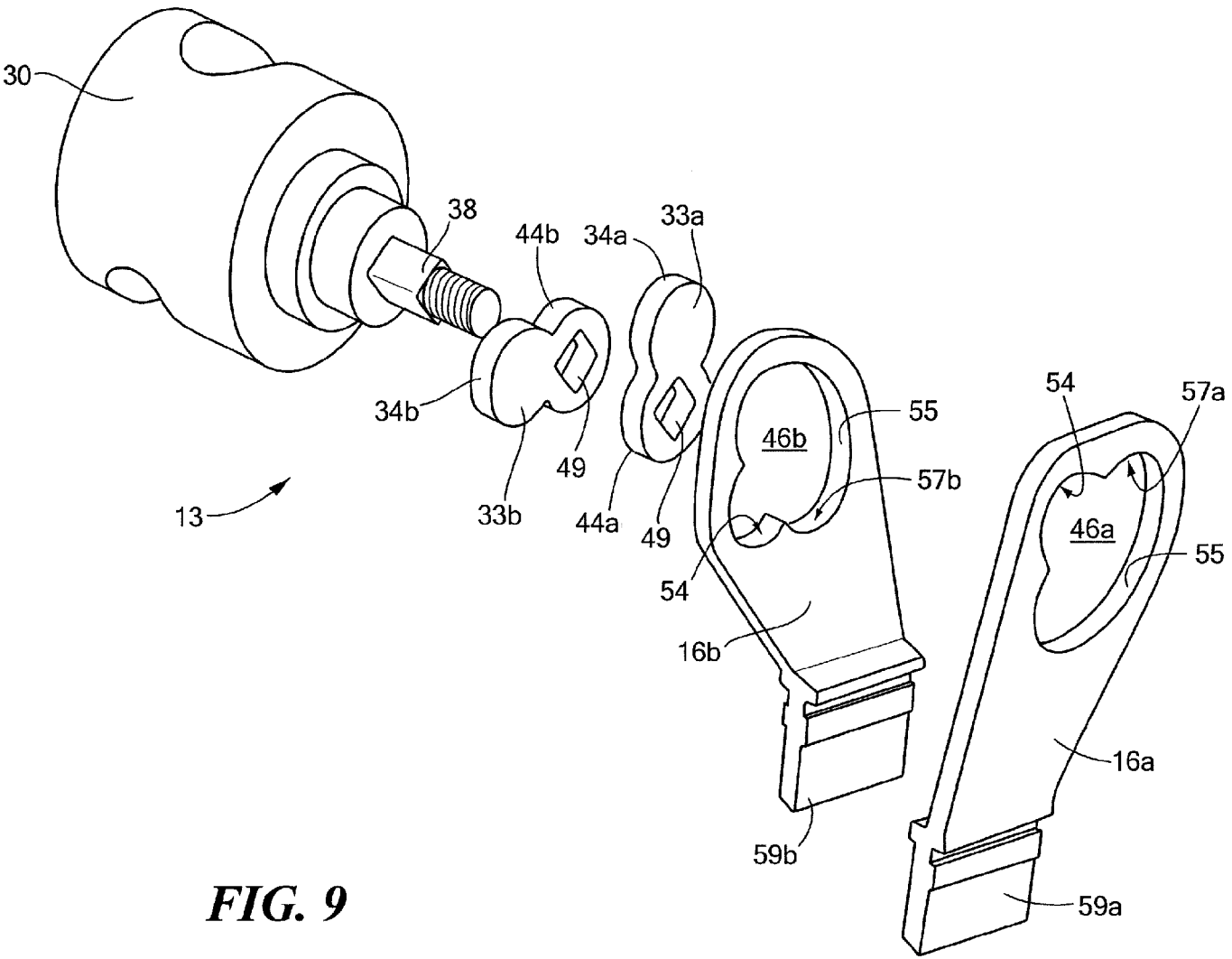
Figure 10:
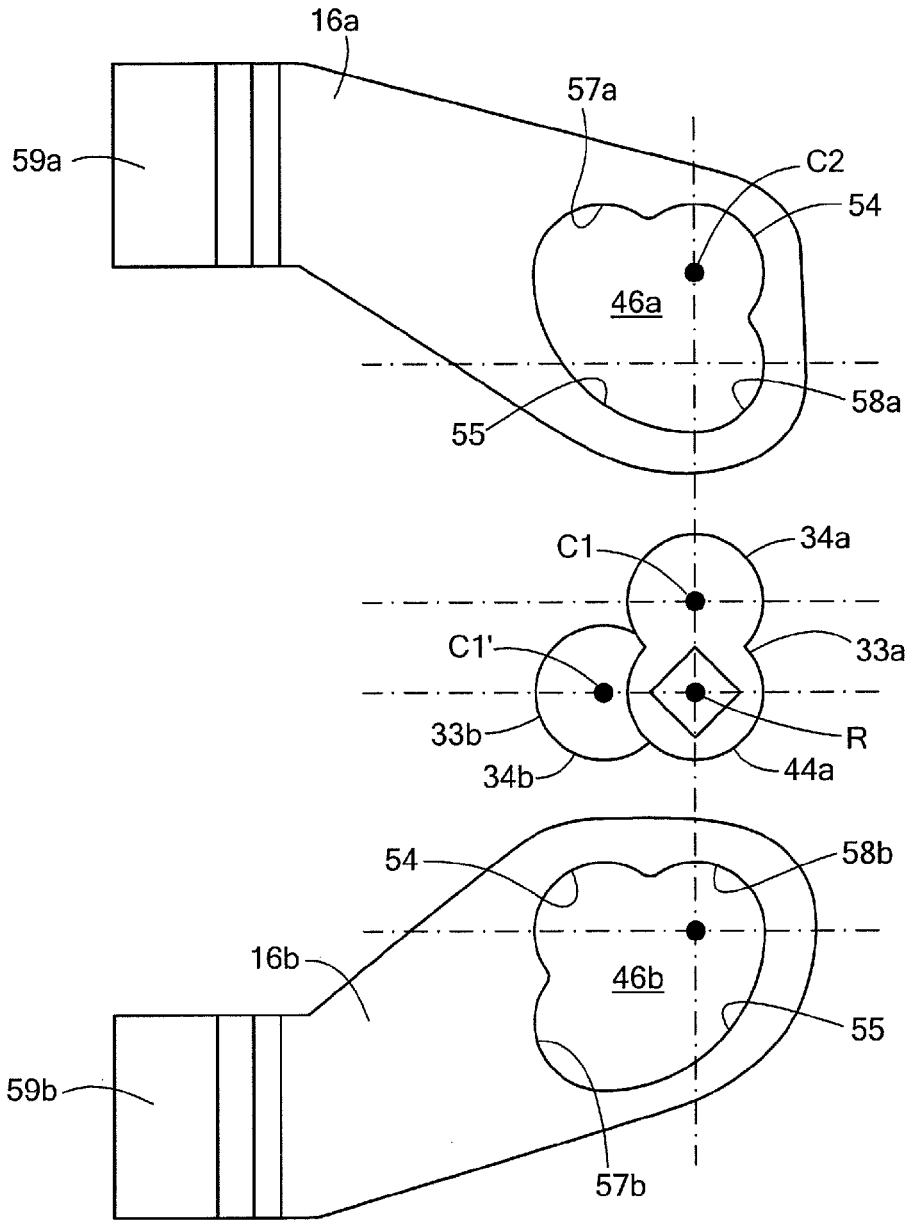
Figure 11:
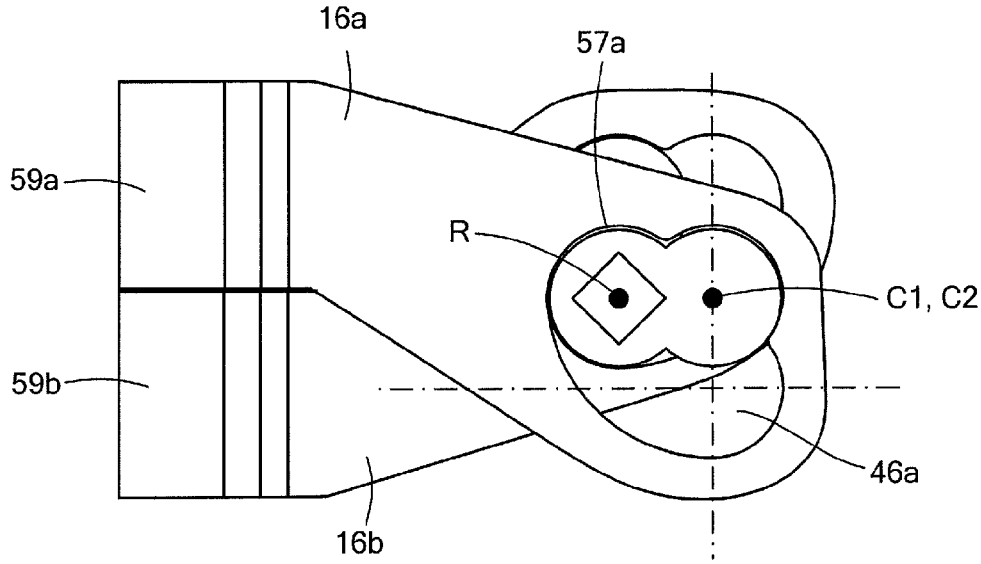
Figure 12:
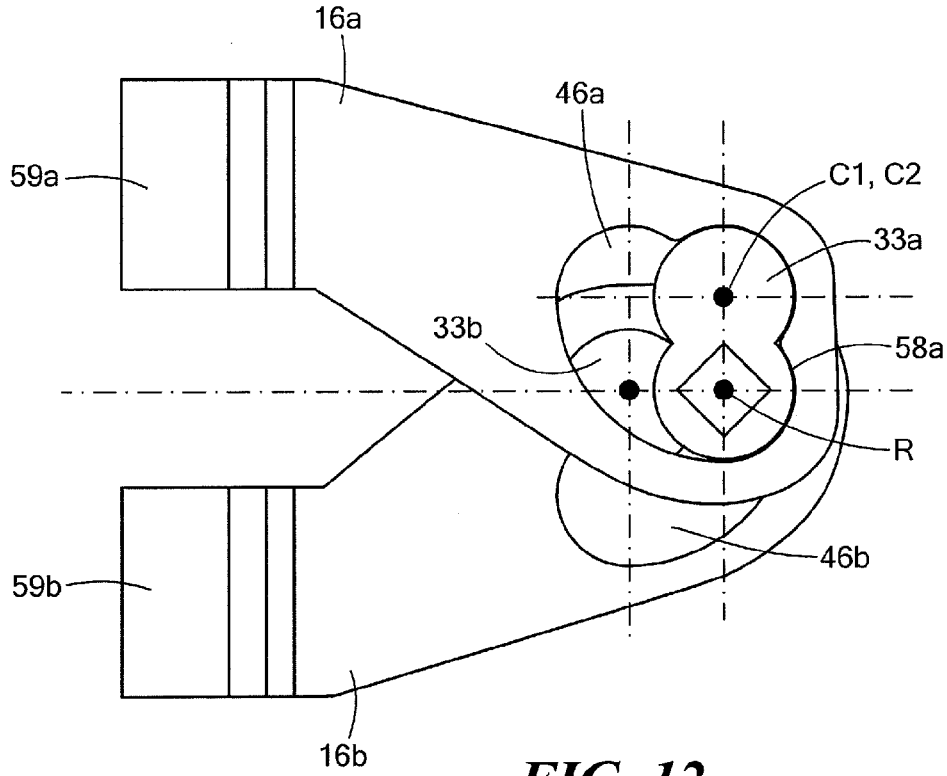
Figure 13:
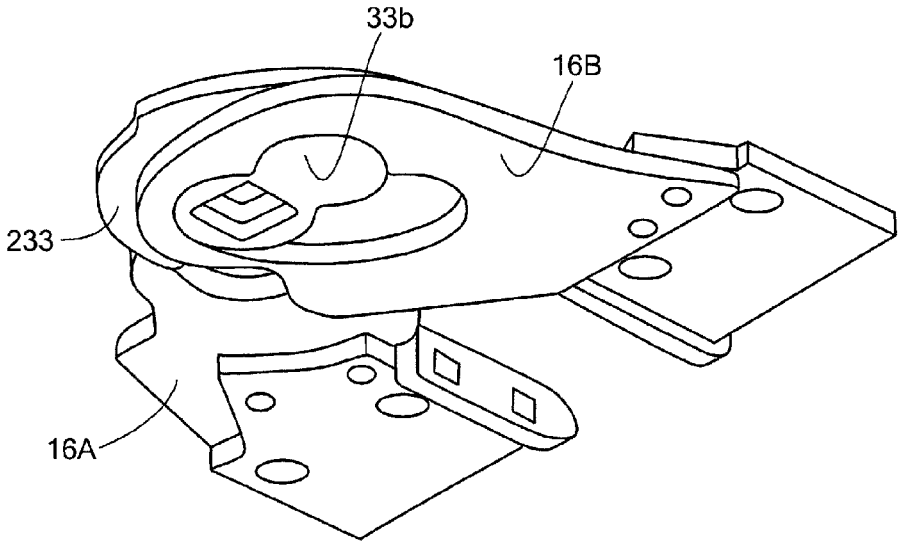
Figure 14A:
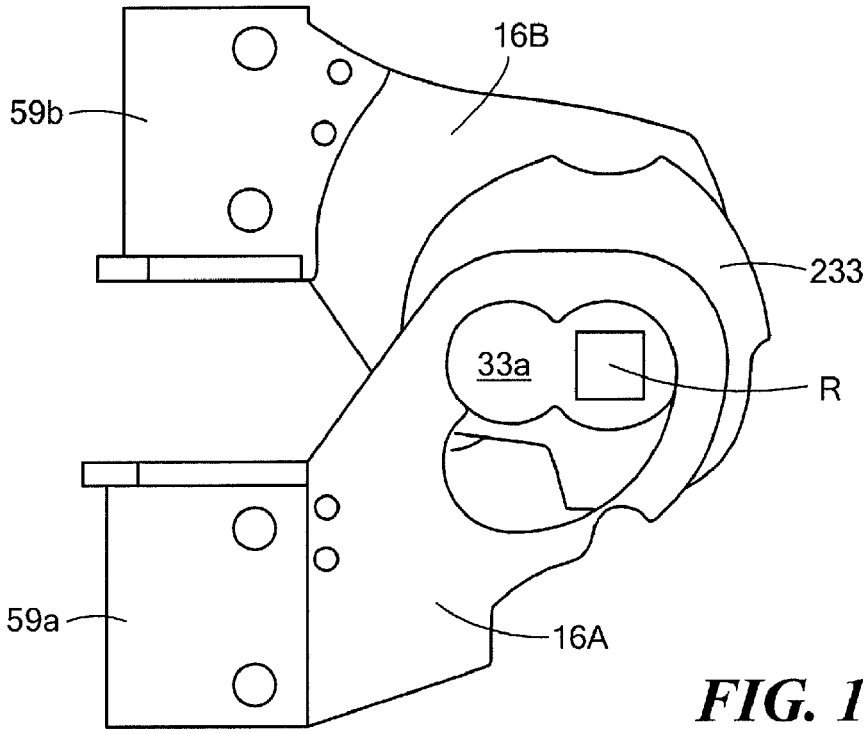
Figure 14B:
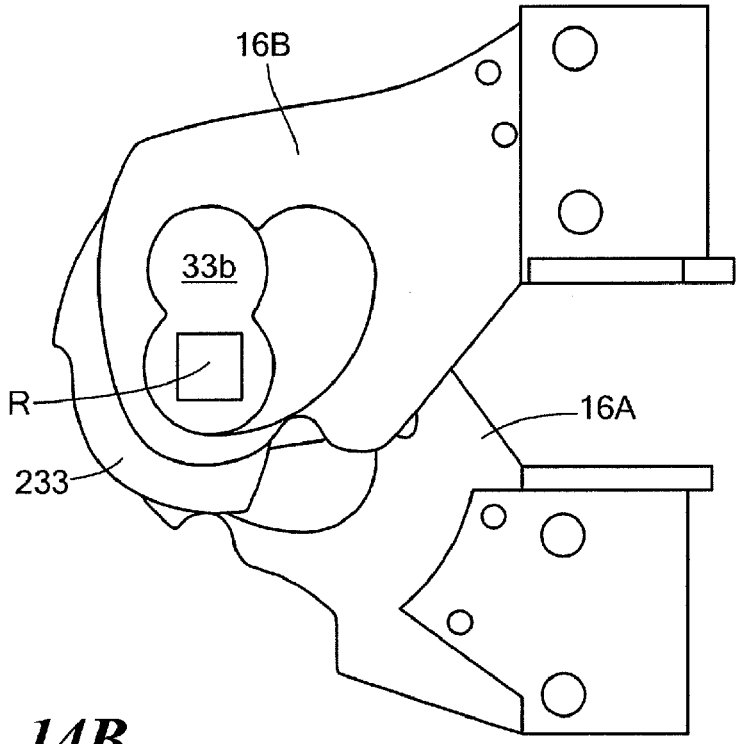
Figure 15A:
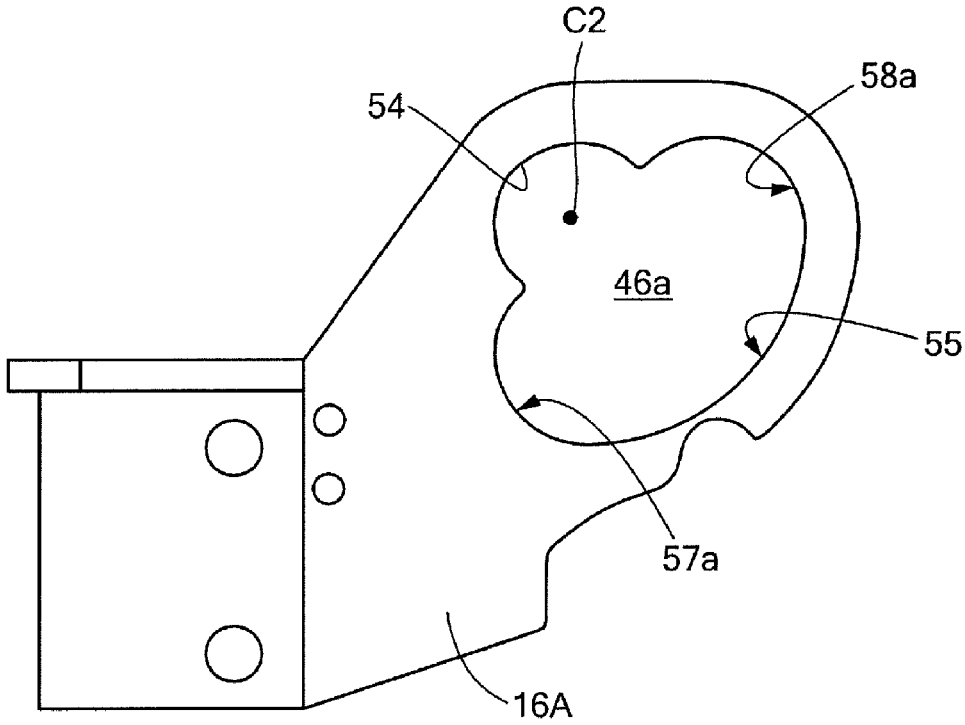
Figure 15B:
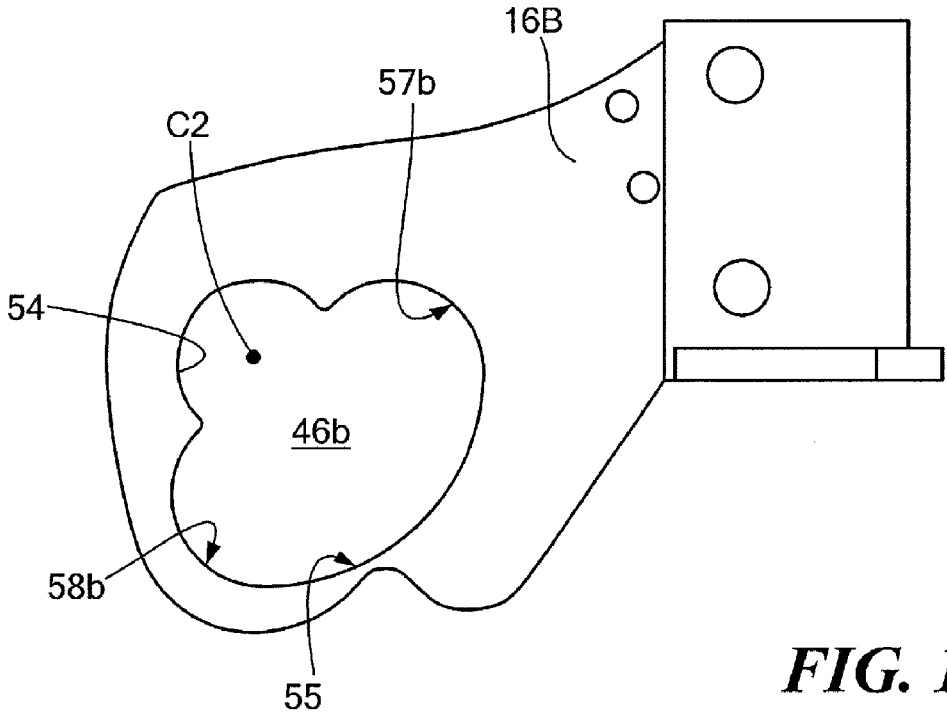
Figure 17A:
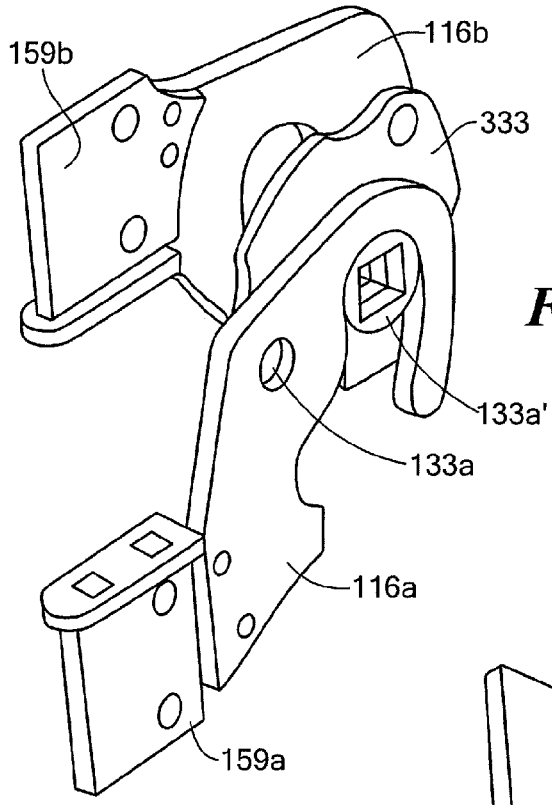
Figure 17B:
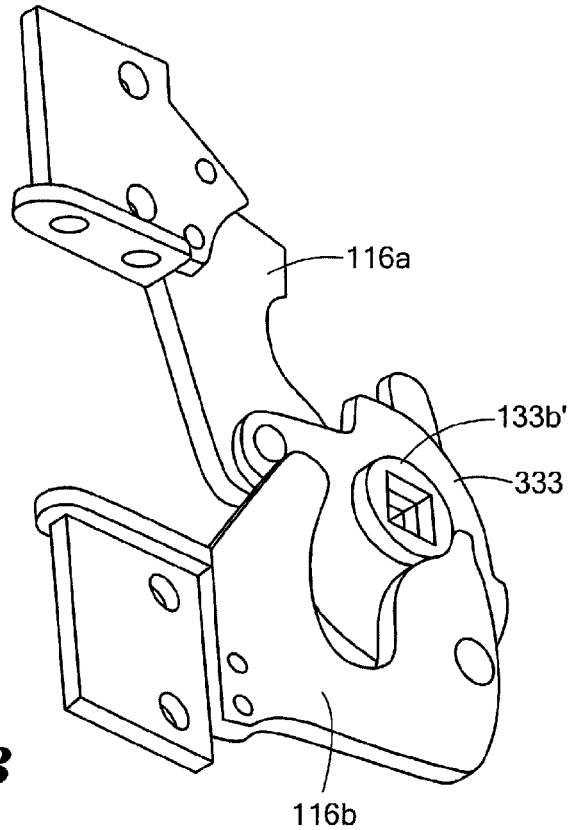
Figure 19:
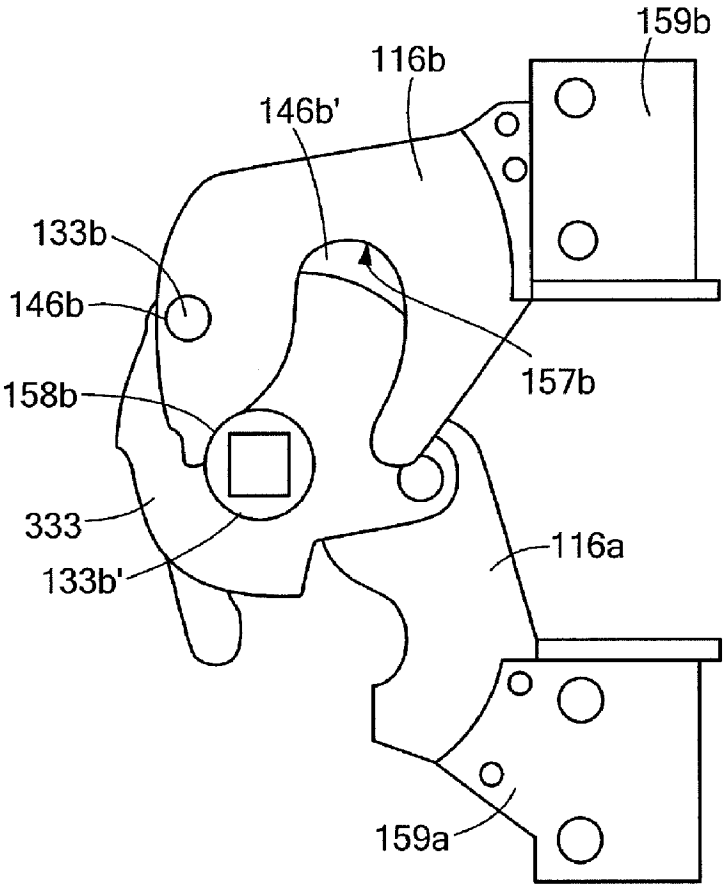
Figure 18:
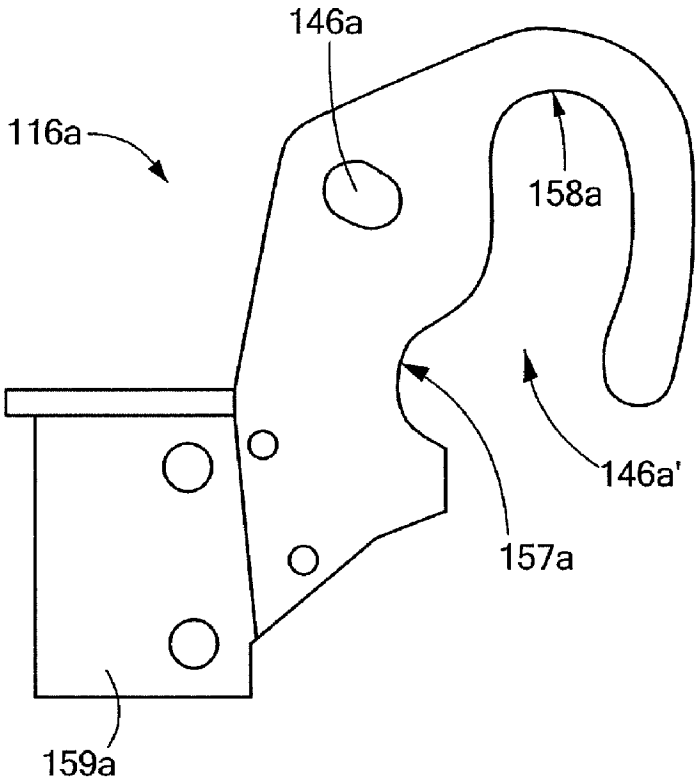
Figure 20A:
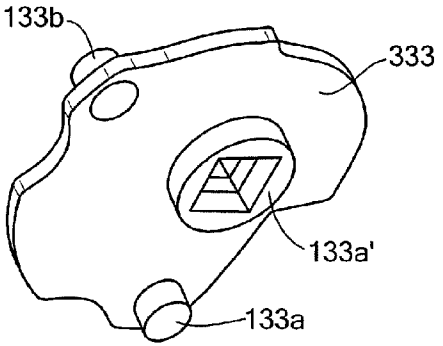
Figure 20B:
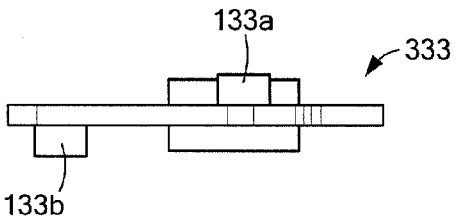
Figure 20C:
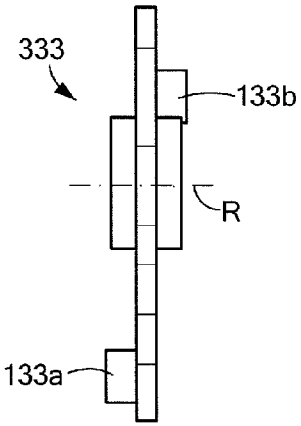
Figure 20D:
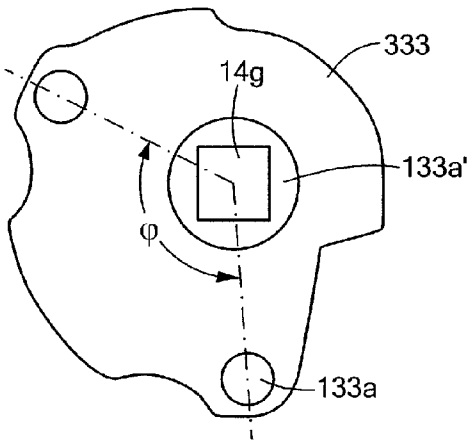
Figure 20E:
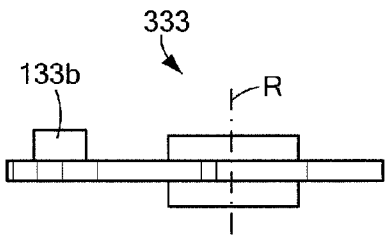
Figure 20F:
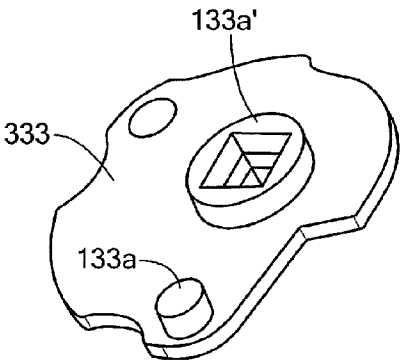
Figure 26B:
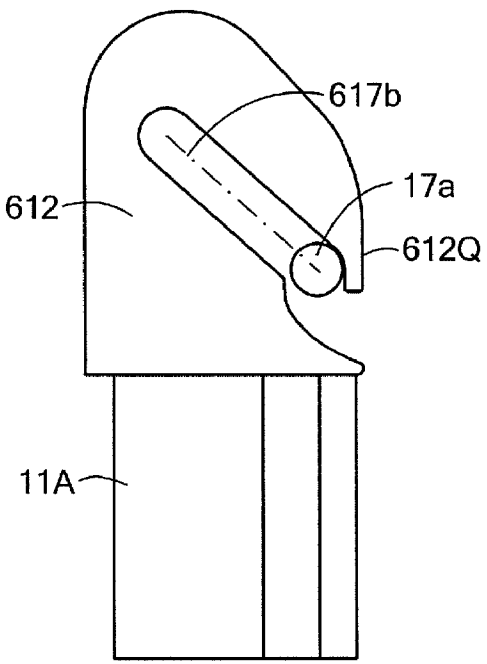
Figure 26A:
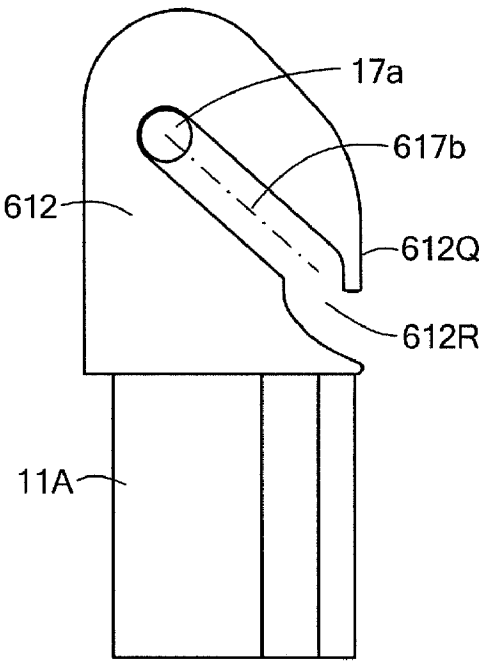
Figure 25:
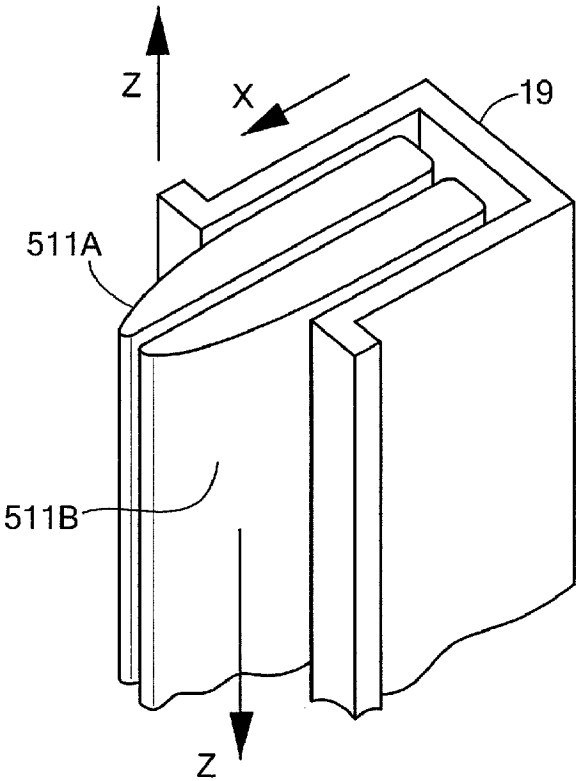

Further elaborations of the invention are described in the dependent claims. The invention will presently be explained with reference to exemplary embodiments and the drawing. Therein shows:

FIG. 1A a vertical cross-section of a first embodiment of the invention, wherein the latches are in a retracted position FIG. 1B a horizontal cross-section over line IB-IB of FIG. 1A;

FIG. 2A a vertical cross-section of the first embodiment, wherein the latches are in an extended latching position FIG. 2B a horizontal cross-section over line IIB-IIB of FIG. 2A;

FIG. 3A a partially opened front view of a second embodiment of the invention, wherein the latches are in a retracted position FIG. 3B a partially opened front view of the second embodiment, wherein the latches are in an extended latching position FIG. 4 part of the second embodiment in perspective view, showing part of the upper first latch and the upper second latch in more detail;

FIG. 5 a partially opened front view, similar to FIG. 3B, of a third embodiment of the invention, wherein the latches of the two panels are in the latching positions;

FIG. 6A and FIG. 6B cross-sections over lines VIA-VIA and VIB-VIB, respectively, of FIG. 5;

FIG. 7 a perspective view of an upper part of the third embodiment of FIG. 5, in the latching position;

FIGS. 8A and 8B similar views as FIG. 1A and FIG. 1B of a fourth embodiment, comprising an alternative operating means;

FIG. 9 an exploded view of part of a first embodiment of operating means of an assembly according to the invention;

FIG. 10 a front view of components of the operating means shown in FIG. 9, in a disassembled position;

FIG. 11 a similar front view as FIG. 10 showing the components of the operating means in a panel releasing position, FIG. 12 a similar front view as FIG. 11 wherein the components of the operating means are in a panel latching position, FIG. 13 a perspective view of part of a second embodiment of the operating means;

FIGS. 14A and 14B a front and back view, respectively, of the embodiment shown in FIG. 13;

FIG. 15A a front view of a first cam follower of the embodiment of FIG. 13;

FIG. 15B a back view of a second cam follower of the embodiment of FIG. 13;

FIGS. 16A to 16F various views of an intermediate cam plate part of the embodiment of FIG. 13;

FIGS. 17A and 17B a perspective front view and back view of part of a third embodiment of the operating means;

FIG. 18 a front view of a first cam follower of the third embodiment of FIG. 17;

FIG. 19 a back view of an assembled configuration of the third embodiment of FIG. 17;

FIGS. 20A-20F six views of part of the embodiment of FIG. 17;

FIGS. 21-24 subsequent latching and locking operations of part of an embodiment of the invention;

FIG. 25 part of an alternative embodiment of the invention, in perspective cross-section; and FIGS. 26A and 26B side views of an alternative latch end part, in case the respective latch is in its panel-release position and panel blocking position respectively.

Similar or corresponding features are denoted by similar or corresponding reference signs in the present patent application.

FIRST NON LIMITING EMBODIMENT

FIGS. 1-2 show a first embodiment of the invention. The first embodiment is an assembly comprising a moveable panel 1, for example a swinging door, leaf or window of a building, or a swinging part of a cabinet, or an other type of panel 1. In the present embodiments, the panel 1 is a square or rectangular panel, however, the panel can also have different shapes. For example, the panel 1 can be moveable with respect to a respective stationary frame 8 and/or element 2. In the present description, the panel 1 will be referred to as being a vertical panel, for example configured to substantially close a vertical opening or passageway in a respective frame in the case the panel is in a first position that is shown in FIGS. 1 and 2. A second panel position, wherein the vertically orientated panel 1 is partly opened—for example with respect to the frame 8 and element 2—, is not shown. For example, the panel 1 can be swivelled or swung to the second position to provide access to the respective opening or passageway.

Alternatively, the assembly can also be provided with a horizontally orientated panel, or a panel orientated in a different manner, when the panel is in the first position as will be appreciated by the skilled person. In the present embodiment, at one vertical side (not shown), for example, the panel 1 can be pivotally connected to a vertical frame part (not shown) of a frame that abuts a respective opening or passage for receiving the panel 1.

The embodiment of FIGS. 1-2 comprises a latching mechanism 10 for latching the panel 1 to at least one nearby element 2, 8 in case the panel 1 is in the first, particularly closed, position, the latching mechanism 10 being provided with two first latches 11*a*, 11*b* (which can also be named, for example: bolts, or sealing elements or isolating members, if desired) and with operating means 13 for moving the latches 11*a*, 11*b* from panel-releasing positions (see FIGS. 1A, 1B) to panel-latching positions (see FIGS. 2A, 2B) and vice-versa. In the present assembly, the two first latches 11*a*, 11*b* are aligned with respect to each other, such that they extend substantially in-line with each other in vertical direction (one latch 11*a* above the other latch 11*b*) when they are in the panel-releasing position.

Advantageously, the first latches 11*a*, 11*b* are dimensioned such that they extend along substantially an entire first lateral side 4 of the panel 1. In the present embodiment, this first lateral side 4 is a vertical lateral panel surface that extends opposite the element 2 in the case that the panel 1 is in the closed position, and when that element 2 is in the position as shown in FIGS. 1B, 2B; also, in the embodiments, a mentioned lateral side extends perpendicularly between the edges of a front and back face of the panel 1. Particularly, the latches 11 extend along substantially the entire first lateral side of the panel 1. For example the overall length of the first latches 11*a*, 11*b* (measured in vertical direction in the present embodiment) can be at least half the length L of that first lateral side, and particularly about 80% of the length L of that first lateral side or more. However, preferably, the overall length of the first latches 11*a*, 11*b* is about the same as the length L of the first lateral side 4 of the panel 1, measured in vertical direction in the present embodiment (see FIG. 1A), and can particularly be equal to that length L.

Besides, the first latches 11*a*, 11*b* can move from the first lateral side 4 of the panel 1, partly towards the opposite element 2, and vice-versa back towards the panel 1. Preferably, the first latches 11*a*, 11*b* can move out of the first lateral side 4 of the panel 1 and vice-versa, as in the present embodiments (in the case that the latches are integrates in the panel 1).

As follows from FIGS. 2A, 2B, parts of the first latches 11 extend horizontally outside the panel 1, substantially along the overall first lateral side 4 thereof, in case the latches 11 have been moved to the latching positions. Also, in that position, the remaining parts of the latches 11 still extend within the panel 2 (i.e. within grooves/profiles 18, 19 mentioned below). Therefore, the latches 11 can substantially seal a (vertical) slit S that extends between the panel 1 and the nearby element 2 (see FIGS. 1B, 2B), besides providing a latching function.

In one embodiment, the latches 11 can only move in horizontal direction (indicated by an arrow X) out of the panel and backwards. However, advantageously, the configuration is such that the two latches 11*a*, 11*b* also move over a certain distance away from each other, in directions Z (indicated by arrows Z in FIG. 1A) parallel to the first lateral side 4 of the panel 1, upon operation of the operating means 13, and vice-versa. In this way, the panel 1 can also be latched to the upper and lower frame elements 8 (see FIG. 2A), to provide an improved latching. For example, the latches 11*a*, 11*b* can be moveable away from each other, in vertical directions, over a distance in the range of 1-10 cm, preferably over a distance in the range of about 1-5 cm, of over a different distance. In particular, each latch 11*a*, 11*b* as such can be moveable in a respective vertical direction, over a distance in the range of 3-20 mm, preferably over a distance in the range of about 5-15 mm, of over a different distance, or over a different distance. Also, in an embodiment, each latch 11*a*, 11*b* is moved in a horizontal direction X over a distance in the range of 0.5-5 cm, for example a range of about 1-2 cm, or a different distance.

The first lateral side 4 of the panel 1 is preferably provided with an opening, particularly a longitudinal groove 18 (or grooves 18), which receives the first latches 11 when that latches 11 are in the respective panel-releasing position. In that case, the latches 11 can preferably be located completely inside the panel 1, to allow movement of the panel 1. In the present embodiment, the longitudinal groove 18 is provided with a latch receiving profile 19, for example a metal or steel profile 19 having a substantially U-shaped cross-section (see FIG. 1B, 2B), and having suitable dimensions to take in the first latches 11 completely. In the present embodiment, the longitudinal groove 18 extends continuously along the whole lateral side 4 of the panel 1.

For receiving the parts of the latches 11*a*, 11*b*, that protrude horizontally from the panel 1 when the latches 11 are in their latching positions, the element 2 comprises an elongated latching aperture 5. The overall length of this latching aperture 5 is, for example, at least about the same as the length L of the first lateral side 4 of the panel 1. Besides, the vertical latching aperture 5 can be reinforced with a vertical latching profile 6, for example made of metal or steel, which profile can have a substantially U-shaped horizontal cross-section (see FIG. 1B, 2B).

In a further embodiment, the vertical latching profile 6 can be provided with dedicated hook members (not shown) facing the panel 1 when it is in the first panel position, and the latches 11*a*, 11*b* can be provided with hooking apertures (not shown), or vice-versa, to cooperate with each other in the case the latches 11*a*, 11*b* have been moved into the latching profile 6. Such hook members and hooking apertures can engage each other to provide a further blocking of the latches 11*a*, 11*b* in a longitudinal direction thereof, for example to relieve longitudinal forces (i.e. strain or pull relieve).

Advantageously, the elongated latching aperture 5, or its optional vertical reinforcing profile 6, can be provided with or at least be partly filled by a sealing material (not shown), for example a resilient material, foam material, a rubber strip, resilient plastic material or a different suitable sealant. The configuration of the sealing material can be such that the latches 11*a*, 11*b* can be partly forced into that material (in a horizontal direction)—or at least make a substantially uninterrupted contact with that material—as a result of a latching procedure (in case the latches 11 have been brought to the positions shown in FIG. 2), to provide an improved sealing of a gap between the panel 1 and the element 2 having the elongated latching aperture 5.

For receiving upper and lower end parts 12 of the latches 11*a*, 11*b*, that protrude vertically (upwardly and downwardly) with respect to upper and lower sides of the panel 1 when the latches 11 are in their latching positions (the two latch end parts being faced away from each other), the opposite upper and lower frame members 8 can also comprise latching apertures 9*a*, that may be reinforced by respective latching profiles 9*b* which can receive the latch end parts 12. As follows from the drawings, the latches 11 can have curved, convex, upper and lower end surfaces, and the respective apertures 9*a* and/or reinforcing profiles 9*b* can have respective curved concave shapes, to match the shape of the latch end parts, and to allow a relatively tight fit of the latch end parts 12 into the respective receiving apertures 9*a* (i.e. profiles 9*b*).

In the present embodiment, one mentioned nearby element 2 extends vertically, opposite the first lateral side 4 of the panel 1 in the case the panel is in the first position (see FIGS. 1, 2; for clarity, the vertical element 2 is not shown in FIGS. 1A and 2A). In one embodiment, this element 2 can be a stationary part, for example of a frame, that abuts the respective opening or passage for receiving the panel 1. In that case, the element 2 can be fixed to upper and lower frame members 8 of the frame, and the latching mechanism 10 can provide simultaneous latching of the single moveable panel 1 to the that vertical frame element 2 and to the horizontal upper and lower frame members 10, as will be explained below.

In an alternative embodiment, the nearby element 2 can be a moveable panel as well, for example a swinging door, leaf or window of a building, or a swinging part of a cabinet, or an other type of panel. In the latter case, the latching mechanism 10 can provide simultaneous latching of both panels 1, 2 to the upper and lower frame members 10, as will be clear from the following. For example a second moveable panel 2 can be arranged with a respective lateral side opposite the first lateral side 4 of the first moveable panel 1 when the panels are in respective first positions. FIGS. 5 and 8 show other embodiments, comprising two moveable panels (see below).

The first latches 11*a*, 11*b* can be made of various materials, and can be dimensioned in various ways. Preferably, each latch 11*a*, 11*b* comprises a durable, elongated, preferably continuous, metal or steel bar to provide a strong latching of the panel 1. Also, for example, the first latches 11*a*, 11*b* can be solid latching members, or can be hollow to save material. In each case, preferably, the outer end parts 12 of the latches are solid latching parts, for example robust solid metal or steel parts 12, to provide a robust latching at upper and lower panel edges In the case that latching requirements are less strict, the latches 11*a*, 11*b* can also be made of wood, plastic and/or other materials.

In an embodiment, each of the two latching members 11 can have a length of about half the length L of a respective first lateral side of the panel 1 or more. For example, the two latches 11*a*, 11*b* can have the same lengths, in which case their opposite ends will preferably meet each other near the vertical middle of the panel when the latches 11 are in the panel-releasing position (see FIG. 1A). Also, the latches 11*a*, 11*b* can be of different lengths: in the latter case, the opposite latch ends will generally not meet each other near a vertical middle of the panel 1. The ratio of the lengths of the latches 11 can depend, amongst others, on a desired (vertical) position of the operating means 13.

Besides, each latching member 11 can have various dimensions and shapes. For example, each latching member 11 can have a width measured perpendicularly to a respective lateral side 4 of the panel of at least 2 cm, and can preferably have a thickness of at least 5 mm. Also, the application of other dimensions is within the scope of the invention. In each case, preferably, the thickness and width of the latch 11 can be much smaller than its length, for example by a factor of at least 10×, and particularly by a factor of at least 50×. The skilled person will appreciate that such dimensions can also depend on the dimensions of the panel 1. Besides, as follows from the drawing, preferably, an outer surface of each latch that is faced away from the panel 1 can be convex and curved (viewed in a horizontal cross-section), for example rounded, to allow a smooth sliding into an opposite latching profile 6.

In the present embodiment (FIG. 1-2), the latching mechanism also comprises guiding means 17 to assist in guiding each first latch 11*a*, 11*b* from the panel-releasing position to the respective panel-latching position and vice-versa, during operation of the operating means 13. In the present embodiment, the guiding means 17 are configured to guide the outer end parts 12 of the first latches 11 from first positions (see FIG. 1) wherein these end parts 12 are located within the panel 1, towards second positions (see FIG. 2) wherein the end parts 12 of the latches 11 reach away from the panel 1 in the horizontal direction X, that is perpendicular to the first lateral side of the panel, and also in the vertical direction Z (that is parallel to the first lateral side of the panel 1). For example, the guiding means 17 can be configured to guide to outer latch end parts 12 along curved paths between the two positions, or along substantially straight parts as in the present embodiment. During operation, the guiding means 17 cooperate with the operating means when the operating means set opposite ends (inner end parts) of the latches 11 into motion, to move the latches 11 between respective positions.

More particularly, the guiding means comprise guiding cams 17*a* and guiding slits 17*b*, in cooperating arrangement to allow the described guiding of the latches 11*a*, 11*b*. In the present embodiment, each latch 11 is provided with a single guiding slit 17*b* and the panel 1 is provided with the respective guiding cams 17*a*, for example horizontal cylindrical protrusions 17*a*, that protrude/extend into the slits 17*b*. Clearly, the configuration can also be reversed, wherein a latch 11 is provided with a guiding cam and the panel 1 is provided with a respective guiding slit. Particularly, in the present embodiment, the guiding cams 17*a* are located short distances away from upper and lower edges of the panel 1. Each of the guiding slits 17*b* extends obliquely with respect to the first lateral side 4 of the panel 1, and with respect to the longitudinal directions of the latches 11. A slope of each guiding slit 17*b* can include, for example, an angle $\alpha$ in the range of about 25°-75° (about 45° in the present embodiment), or a different angle, with respect to a respective horizontal plane. The configuration is particularly such that the guiding slits 17*b* are directed towards the latching apertures 9*a* (and optional latching profiles 9*b*) of the upper and lower frame members 8 when the panel 1 is in its first (closest) position, to provide the proper guiding of the outer latch end parts 12.

FIGS. 26A, 26B show an alternative embodiment of the guiding means, which differs from the above-described embodiment shown in FIG. 1-2 in that the outer end of each guiding slit 617*b* is at least partly blocked by a protrusion 612Q of the end part 612 of the respective latch 11*a* (only the upper latch 11*a* is shown, however, the same can apply to the other first latch 11*b*, or any other latches 511, 21 mentioned in the embodiments below). The protrusion 612Q is configured to assist in preventing that the guiding cam 17*a* leaves the guiding slit 617*b* when the respective latch 11*a* has been brought to its panel-blocking position during normal operation. To this aim, the protrusion 612Q is dimensioned to abut the vertically guiding cam 17*a* when the respective latch 11*a* has been brought to the panel-blocking position (see FIG. 26B. The outer end of each guiding slit 617*b* adjoins an assembly/dissasembly opening 612R circumventing the protrusion 612Q, and being located off-line with respect to the guiding slit 617*b*, the opening 612R allowing the guiding cam 17*a* to enter and leave the slit 617*b* during assembly/dissasembly of the embodiment. The skilled person will appreciate that the guiding means can also be configured in a different manner.

Advantageous embodiments of the operating means 13 will be described below and are shown in FIGS. 9-24. Particularly, the operating means 13 can comprise a preferably manually operable operating member 30, for example a handle, knob, lever, panic opener, or other suitable means. Alternatively, the operating means can be electronically controllable. The operating member 30 is coupled to the opposite inner end parts (located near one another) of the first latches 11*a*, 11*b*, via operating arms 16 (which are cam followers 16 in the embodiments described below concerning FIGS. 9-24). When the operating member 30 is moved from a first operating position (shown in FIG. 1) to a second operating position (shown in FIG. 2), the operating arms (i.e. cam followers) 16 are moved outwardly, i.e. in the horizontal direction X away from the panel 1, as well as vertically away from each other, leading to the outward movement of the latches 11*a*, 11*b*, so the latches 11 can reach the opposite latching aperture 5 (and profile 6) of the opposite element 2. For example, each latch 11 is moved in a substantially skewed direction out of the panel 1, i.e. at an angle in the range of about 25°-75° upwardly for the upper latch 11*a*, and at an angle in the range of about 25°-75° downwardly concerning the lower latch 11*b*.

When the operating member 30 is moved back towards the first operating position, from the second operating position, the operating arms (i.e. cam followers) 16 are moved inwardly, into the panel 1, as well as vertically towards each other, leading to the inward movement of the elongated vertical latches 11*a*, 11*b*, to their initial panel-releasing positions.

Preferably, during an operation to move the latches 11 towards the latching positions, the latches 11 are first being moved outwardly at their nearby inner end parts and shortly thereafter (i.e., with a relatively short delay) also at the outer end parts 12 due to the guiding provided by the guiding means 17, such that the latches 11 have small tilted orientations (e.g. of several degrees) with respect to the opposite latching aperture 5 and respective vertical latching profile 6. In that case, each latch 11*a*, 11*b* can 'cut' into the opposite latching profile 6 (similar to 'a knife cutting through paper'), in which case preferably the inner end part of each latch 11 reaches the latching profile 6 first, and neighbouring latch parts of that latch follow subsequently, in linear sequence and in a continuous manner, until the respective outer latch part 12 reaches the latching profile 6 last. In this way, operation of each latch 11 can be carried out in a reliable manner. The present embodiment can also provide a good thermal and/or sound isolation to a panel/frame assembly, as follows from the above.

In the embodiment of FIGS. 1-2, two first latches 11*a*, 11*b* are provided, being located substantially vertically aligned with respect to each other, one above the other. FIG. 25 shows part of an alternative embodiment, in perspective cross-section, which is substantially the same as the embodiment of FIG. 1-2 but differs in that two first latches 511*a*, 511*b* are provided, extending alongside each other, in vertical direction, wherein the operating means 13 can move the first latches 11*a*, 11*b* from the first lateral side 4 of the panel 1, partly towards the opposite element 2, and vice-versa back towards the panel 1, and wherein one of the latches 511*a* is movable upwardly and the other latch 511*b* downwardly, to respective latching positions (similar to the embodiment of FIGS. 1-2). In other words: the first latches are moveable in opposite (vertical) directions with respect to each other as well as out of the first lateral side 4 of the panel 1, towards their panel latching positions.

In the FIG. 25 embodiment, when the first latches 511*a*, 511*b* are in their panel-release positions, they substantially extend along side to each other, with vertical sides of the lathes 511*a*, 511*b* being faced towards each other i.e., overlapping each other in horizontal direction, as in FIG. 25, and being located substantially within the panel 1 (or the latch receiving profile 19). Preferably, the first latches 511*a*, 511*b* can move out of the first lateral side 4 of the panel 1 and vice-versa, as in the FIG. 1-2 embodiment (in the case that the latches are integrates in the panel 1). In The FIG. 25 embodiment, each of the first latches 511*a*, 511*b* can have substantially the same length as the first lateral side of the panel 1 (measured in vertical direction Z). Thus, both lathes 511*a*, 511*b* can provide an even better sealing and isolating of the slit S that extends between the panel 1 and the nearby element 2 (see FIGS. 1B, 2B), besides providing a latching function. In an other embodiment, the first latches 511*a*, 511*b* can have an overlapping relation (i.e., in a transversal direction with respect to the panel 1, perpendicularly with respect to a panel front and back face,) as in FIG. 25 when they are in their panel-release positions, but have smaller lengths than the length L of the first lateral panel side, for example to save material. For example, the two first latches can at least (in the present embodiments horizontally) overlap at and/or near the operating means 13, i.e. at their nearby end parts, to seal the above-mentioned slit S at the respective location. In each case, in the present embodiment, the overall length of the two first latches 511*a*, 511*b* can be larger than the length L of the respective lateral panel side 4. Besides, for example, in the embodiment, of FIG. 25, each latch 511*a*, 511*b* can have a width measured perpendicularly to a respective lateral side of the panel (in the X-direction in the present drawing) of at least 2 cm, and can have a thickness of at least 2 mm, or be dimensioned differently.

SECOND NON LIMITING EMBODIMENT

FIGS. 3A, 4B, 4 show a second embodiment of the invention, which differs from the embodiment of FIGS. 1-2 in that there are also provided second, substantially horizontal, elongated latches 21A, 21B that are moveable from panel-releasing positions (see FIG. 3A) to a panel-latching positions (shown in FIG. 3B) and vice-versa, wherein the second latches 21 extend along second lateral sides of the panel 1. In the present embodiment, the second lateral sides are the upper and lower lateral panel sides, and the second latches 21 are elongated upper and lower latches, extending perpendicular with respect to the first latches 11. Preferably, the length of each second latch member 21 is substantially the same as the length of the respective second lateral panel side. The second latches 21*a*, 21*b* can move out of the second lateral sides of the panel 1, towards the opposite frame members 8 (not shown in FIGS. 3B, 4).

The function of the second latches 21 with respect to the horizontal frame parts 8 can be similar to the function of the first latches with respect to the vertical element 2. For example, the second latches 21 can latch the panel 1 to the horizontal frame parts 8 and/or to seal or isolate horizontal slits extending between the upper and lower sides of the panel 1 and those horizontal frame parts 8. As in the embodiment of FIGS. 1-2, for example, the second (horizontal) lateral sides of the panel 1 can be provided with horizontal longitudinal grooves 28 to receive the second latches 21 when these latches 21 are in the respective panel-releasing position. Preferably, these longitudinal horizontal grooves 28 can be provided with latch receiving profiles 29, for example a metal or steel profiles having a substantially U-shaped cross-sections, and having suitable dimensions to take in the second latches 21 completely. These longitudinal groove 28 and profiles 29 can extend continuously along the whole second lateral sides of the panel 1. For receiving the parts of the second latches 21, that protrude vertically from the panel 1 when the latches 21 are in their latching positions, the frame members 8 can comprise elongated latching aperture (not shown as such, for clarity). The overall length of each of these latching apertures can be, for example, at least about the same as the length (measured in a horizontal direction X) of the second lateral sides of the panel 1. Besides, these horizontal latching apertures of the frame members 8 can be reinforced with a suitable latching profiles, for example made of metal or steel, which profiles can have a substantially U-shaped horizontal cross-sections. Advantageously, such elongated latching apertures, or its optional vertical reinforcing profile, can be provided with or at least be partly filled by a sealing material (not shown), for example a resilient material, foam material, a rubber strip, resilient plastic material or a different suitable sealant, to provide an improved sealing of horizontal gaps between the panel 1 and the frame member 8 having the elongated latching aperture.

Besides, in the second embodiment, the latching mechanism also comprises guiding means 27 to assist in guiding each second latch 21 from the panel-releasing position to the respective panel-latching position and vice-versa. More particularly, these guiding means can comprise guiding cams 27*a* and guiding slits 27*b*, in cooperating arrangement to allow the described guiding of the latches 11*a*, 11*b*. In the present embodiment, and end part 22 of each second latch 21 is provided with a single guiding slit 27*b* and the panel 1 is provided with the respective guiding cams 27*a*, the guiding slits 27*b* extending substantially parallel to the above-mentioned guiding slits 17*b* of the first latches. Also, preferably, spring members/spring means 39 are provided to counteract outward movement of the second latches via resilient or spring forces, to assist in returning the second latches 21 to their panel-releasing positions. Besides, preferably, the end parts 22 of the second latches 21A, 21B that are faced away from the outer end parts 12 of the first latches can be solid latching parts, for example robust solid metal or steel parts 22, to provide a robust latching at respective upper and lower panel edges. Thus, in case the outer end parts 12 of the first latches 11 are have a robust configuration as well, the panel 1 can be firmly held at its four edges by the latching mechanism.

In a further embodiment, there can also be provided further blocking profiles and/or isolating elements (for example anti-theft/burglar or anti-tampering profiles, and/or isolating strips) extending along a vertical lateral panel side (not shown) that is faced away from the first lateral side 4 of the panel 1. In that case, the panel 1 can be blocked into a first positions along all four lateral sides, and/or the panel 1 can be well isolated (with respect to an adjoining construction, panels and/or frame members) along all four lateral sides. Such Particularly, the first latches 11*a*, 11*b* and the second latches 21A, 21B can cooperate to move the second latches 21 upon movement of the first latches 11. To this aim, in the present embodiment, the second latches 21A, 21B are simply coupled to the outer end parts 12 of the first latches 11*a*, 11*b*, as is clearly visible in FIG. 4. For example, the end part 12 of each first latch 11*a*, 11*b* can be connected to a second latch 21 via a sliding coupling, clicking means, welding, adhesive and/or in a different way. Herein, advantageously, each second latch 21 is slightly pivotal with respect to the first respective latch 11. For example an end part of each second latch 21 can be pivotally connected to the outer end part 12 of a first latch 11 via a pivot axis 25 (see FIG. 4). In this way, during movement of the outer part 12 of the first latch 11 to its latching position, the respective second latch 21 can be pulled to a slightly tilted orientation (e.g. of several degrees, as indicated by arrow β) with respect to an opposite horizontal latching aperture (and respective vertical latching profile) of the opposite frame part 8. In that case, each second latch 21 can also 'cut' into the opposite latching profile, as described above concerning to operation of the first latches 11.

THIRD NON-LIMITING EMBODIMENT

FIGS. 5-7 show parts of a third embodiment, which differs from the embodiment shown in FIGS. 3-4, in that the assembly comprises a first moveable panel 1, as well as a second moveable panel 2 that is located opposite the first lateral side of the first panel 1 in case both panels are in respective first positions (for example to close a respective opening or passageway). The first moveable panel 1 and its latching means 11, 13, 21 of the third embodiment can be configured the same as the embodiment shown in FIGS. 3-4. In this case, the second movable panel 2 is provided with an upper horizontally extending latch 21A' and a lower horizontally extending latch 21B'. Particularly, these latches 21A', 21B' of the second panel 2 are not directly interconnected with any parts of the first panel 1, however, they can be operated by the latching mechanism 13, 11, 21 of the first panel 1, as will be explained in the following.

The function of the latches 21' of the second panel 2 with respect to the horizontal frame parts 8 can be the same as the function of the second latches 21 of the first panel 1 with respect to the horizontal frame parts 8, for example to provide a latching function and/or to seal horizontal slits extending between the upper and lower sides of the second panel 2 and those horizontal frame parts 8. As in the embodiment of FIGS. 3-4, for example, horizontal lateral sides of the second panel 2 can be provided with horizontal longitudinal grooves 28' to receive the second latches 21' when these latches 21' are in the respective panel-releasing position. Preferably, these longitudinal horizontal grooves 28' can be provided with latch receiving profiles 29', for example a metal or steel profiles having a substantially U-shaped cross-sections, and having suitable dimensions to take in the second latches 21' completely. These longitudinal groove 28' and profiles 29' can extend continuously along the whole lateral upper and lower sides of the second panel 2. For receiving the parts of the second latches 21', that protrude vertically from the second panel 2 when the latches 21' are in their latching positions, the frame members 8 can comprise elongated latching aperture (not shown as such, for clarity). The overall length of each of these latching apertures can be, for example, at least about the same as the length (measured in the horizontal direction X) of the upper and lower lateral sides of the second panel 2. Besides, as above, such horizontal latching apertures of the frame members 8, to receive the second panel latches 21', can be reinforced with a suitable latching profiles, for example made of metal or steel, which profiles can have a substantially U-shaped horizontal cross-sections. Advantageously, again, such elongated latching apertures, or their optional vertical reinforcing profiles, can be provided with or at least be partly filled by a sealing material (not shown), for example a resilient material, foam material, a rubber strip, resilient plastic material or a different suitable sealant, to provide an improved sealing of horizontal gaps between the second panel 2 and the frame member 8 having the elongated latching aperture.

Also, in the present third embodiment, opposite end parts 22', 32 of each of the latches 21A', 21B' the second panel 2 preferably have a solid configuration, and can be example metal or steel end parts 22', 23.

Guiding means 27*a*', 27*b*' are provided to assist in guiding each latch 21A', 21B' of the second panel 2 towards the opposite latch receiving openings of the upper and lower frame member 8 (not shown). In the present embodiment, these guiding means 27*a*', 27*b*' are configured to guide the latches 21A', 21B' from first positions) wherein the latches 21A', 21B' are located within the second panel 2, towards second positions (see FIG. 5, 7) wherein these latches 21A', 21B' reach out of the second panel 2, in the horizontal direction X away from the first panel 1, and also in vertical directions Z. In the present embodiment, these guiding means 27*a*', 27*b*' are configured similar to the above-described guiding cams and guiding slits of the latching members 11, 21 of the first panel. For example, in the present embodiment, the end parts 22, 31 of these second panel latches 21A', 21B' include the guiding slits 27*b*'. Preferably, the guiding slits 27*b*' of guiding means of the upper and lower second panel latches 21A', 21B' extend in substantially the same oblique directions as the guiding slits 27*b* of the guiding means of the upper and lower first panel latches 21A, 21B, respectively, as in the drawing.

The two latches 21A', 21B' of the second panel 2 can cooperate with the outer end parts 12 of the first latches 11 of the first panel 1, to be pushed thereby from respective second-panel releasing positions to second-panel latching position (only the latter positions of the upper and lower latch 21A', 2113' of the second panel 2 are shown). Particularly, first end parts 32 of the second panel latches 21A', 21B' can be reached and pushed away from the first panel 1 by the outer end parts 12 of the first latches 11*a*, 11*b*, during operation, to operate the latches 21A', 2113' of the second panel 2. Also, the second panel 2 can be provided with spring means 39' to counteract the outward movement of the respective latching members 21A', 21B', and to return these latching members 21A', 21B' to their second-panel releasing positions in the case that the outer end parts 12 of the first latches 11*a*, 11*b* of the first panel 1 are returned to their panel-releasing positions.

The embodiment of FIGS. 5-7 can provide an efficient latching of the two panels 1, 2, to each other as well as to an encompassing frame 8 (or similar structure). A good sealing of any gaps extending between the panels 1, 2 and the frame can be obtained as well, by the latches 11, 21, 21'. Also, only a single operating means 13 has to be provided to operate all the latches 11, 21, 21' of the two panels. Besides, the present embodiment can provide a good fire resistance, wherein both panels 1, 2 can be firmly fixed to a respective frame 8, with each panel 1, 2 being held by preferably solid or sturdy latch parts 12, 22, 22', 23 at its four corners, so that heat induced warping of the panels 1, 2 can be prevented. Also, in this case, further blocking profiles and/or isolating elements (for example anti-theft/burglar or anti-tampering profiles, and/or isolating strips) can be provided along the vertical lateral panel sides that do not comprise latches 11, 21, 21' as such, as mentioned above. In that way, for example, the two panels 1,2 can be latched at 7 different lateral sides to an adjoining construction (for example of a building, machine, furniture or the-like).

FOURTH NON-LIMITING EMBODIMENT

FIGS. 8A, 8B are similar to FIGS. 1A and 1B and show a fourth embodiment, wherein only two first latches 11A, 11B are provided, to latch a first panel 101 and second panel 102 along opposite lateral (vertical) sides, and to latch both panels 101, 102 to upper and lower frame members 8 at the same time. The operation of the fourth embodiment follows the operation of the first above-described embodiment. In the fourth embodiment, the first latches 11A, 11B can be moved over a relatively long vertical distance D away from each other, for example a distance of at least 2 cm (see FIG. 8B). The upper and lower frame members 8 are provided with relatively deep apertures having steel latch receiving profiles 109 to firmly hold the end parts 12 of the two first latches. To accomplish the movement of the latches, an alternative operating mechanism 113 is provided that will be described below with reference to FIGS. 18-20. Particularly, the latching mechanism of the present fourth embodiment can provide espagnolet-type latching for each of the panels 1, 2 at the same time and can, in addition, substantially seal a vertical slit or gap extending between the panels.

Operating Mechanism Embodiments

The operating means of the assembly according to the invention can be configured in various ways. A relatively durable, very compact and reliable embodiment is shown in FIGS. 1-2, parts of which embodiment are also shown in more detail in FIGS. 9-12. Particularly, the present embodiment can be made relatively compact measured in the transversal direction with respect to the latching members 11, which direction is perpendicular to a front and back surface of the panel 1 after assembly. According to this embodiment, the operating means 13 can comprise two cams 33*a*, 33*b*, each cam 33*a*, 33*b* being rotatable with respect to a rotation axis R (see FIG. 1B, 2B) between a first and second position (particularly including cam rotation over an angle of about 90°). First positions of the two cams 33 are shown in FIGS. 1A and 11, whereas the second positions are shown in FIGS. 2A, 10 and 12.

In the present embodiment, the operating means 30 are provided with a rotatable shaft 38, extending concentrically along the rotation axis R, wherein the two cams 33*a*, 33*b* of the operating means are rotationally fixed with respect to the shaft 38. In this embodiment, the shaft 38 can be rotated by manual operation of the operating member 30. For example, the cams 33*a*, 33*b* can be provided with cam apertures 49 to receive the shaft, the apertures having rotationally fixed relationships with respect to the rotational position of the shaft 38, for example via application of suitable locking shapes of the shaft 49 and cams apertures 49 (such as the square cross-sectional shapes of shaft and cam apertures as shown in the drawings).

In the present embodiment, each of these cams 33*a*, 33*b* is of a mirror-symmetrical configuration with respect to a centre line, and has an outer contour being substantially 8-shaped. Also, the two cams 33*a*, 33*b* have exactly the same shape and dimensions, in this embodiment.

Particularly, the outer contour of each cam 33*a*, 33*b* has a first circle section 34*a*, 34*b*, wherein a virtual centre C1, C1' of each first circle section 34*a*, 34*b* is located eccentrically with respect to the rotation axis R (the first circle section is provided by a first cam part of the 8-shaped cam). Also, as follows from the drawing, the outer contour of each cam 33*a*, 33*b* comprises a second circle section 44*a*, 44*b* that is concentric with respect to the rotation axis R (the second circle section is provided by a second cam part of the 8-shaped cam, that is also provided with the cam aperture 49).

Also, after assembly, the virtual centres C1, C1' of the first circle sections 34*a*, 34*b* of the outer contours of the two cams 33*a*, 33*b* are located off-line with respect to each other when viewed in a direction parallel to the rotation axis R. Particularly, the angle included by virtual lines extending between those centres C1, C1' and the rotation axis R can be about 90°, as in the present embodiment (see FIG. 10-12), or in other words: longitudinal centre lines of the two cams 33*a*, 33*b* extend perpendicularly with respect to each other.

Also, for example, each of the 8-shaped cams 33*a*, 33*b* can be made of metal or steel plate material, or be cast or moulded into the desired shape. Preferably, each cam 33*a*, 33*b* is relatively thin, for example having a thickness T in the range of about 1-5 mm (see also FIG. 16A), such as a range of 2-3 mm, measured in the direction parallel to the rotation axis R.

Besides, there are provided two translatable cam followers 16*a*, 16*b* that are integrally, unmovable, fixed to the respective first latches 11*a*, 11*b*, via end parts 59*a*, 59*b* of the cam followers 16*a*, 16*b*.

In this embodiment, the cam followers 16*a*, 16*b* have respective cam receiving apertures 46*a*, 46*b* that fully enclose the respective cams 33*a*, 33*b*, viewed in a longitudinal cross-section (and also viewed in front view, as in FIGS. 11 and 12), after assembly. These apertures 46*a*, 46*b* are preferably configured to snugly hold the respective 8-shaped cams 33*a*, 33*b* in the longitudinal direction of the 8, and such that each 8-shaped cam 33*a*, 33*b* can still rotate in the aperture 46 between the first and second position (see FIGS. 11 and 12). Each aperture 46 of each cam followers 16*a*, 16*b* also has mirror-symmetry, and both apertures 46 and have exactly the same shape and dimensions. However, after assembly, the orientations of the apertures 46 of both cam followers 16*a*, 16*b* have a substantially 90° rotational shift with respect to each other, viewed in front view (see FIGS. 10-12).

The cam followers 16*a*, 16*b* can also, for example, be made of metal or steel plate material, or be cast or moulded into the desired shape. Preferably, parts of each cam follower 16*a*, 16*b* that abut the cam receiving apertures 46*a*, 46*b* are relatively thin, for example having a thickness in the range of about 1-5 mm, such as a range of 2-3 mm, measured in the direction parallel to the rotation axis R. For example, the thickness of the part of each cam follower 16*a*, 16*b* that abut the respective cam receiving aperture 46*a*, 46*b* can be the same as the thickness of the respective cam 33*a*, 33*b*, to be received in that aperture 46*a*, 46*b*.

Particularly, the aperture 46*a*, 46*b* of each cam follower 16*a*, 16*b* has an inner contour with a first circle section 54 that rotatably receives, and particularly slidingly abuts, the first circle section 34*a*, 34*b* of the outer contour of the respective cam 33*a*, 33*b*, to move the first latches 11 between the releasing and latching position upon rotation of the first cams 33*a*, 33*b* between theirs first and second positions, respectively.

Moreover, the inner contour of the aperture 46 of each translatable cam follower 16 has a second circle section 55 which is configured to be guided along the second circle section 44*a*, 44*b* of the outer contour of the respective cam 33*a*, 33*b* upon rotation of the cam 33*a*, 33*b*. Also, a virtual centre C2 of the second circle section of the inner contour of the aperture 46 of each translatable cam follower 16 coincides with the virtual centre C1, C1' of the first circle section 34*a* of the outer contour of the respective cam 33*a*, 33*b*.

Besides, in the present embodiment, each cam follower acts as a stop, to limit maximum movement of the respective 8-shaped cam 33 between the respective first and second cam position (see the drawing). To this aim, the inner contour of each cam receiving aperture 46*a*, 46*b* has a first circle section stop face 57*a*, 57*b*, to stop the respective cam 33*a*, 33*b* in its first position, and a second circle section stop face 58*a*, 58*b*, to stop the cam in its second position (see FIGS. 10 and 12). Thus, the contour of each cam receiving aperture 46 is provided with the first inner contour 54, two opposite stop faces 57, 58, and the second inner contour 55 extending opposite the first inner contour 54, the second inner contour 55 guiding the cam 33 between the stop faces 57, 58 over an angle of 90°.

During operation, the operating shaft 38 can be rotated, leading to rotation of the two cams 33. For example, FIGS. 1A, 1B and 11 show a starting position, where the latches 11 are in the panel-releasing positions and the end parts 59*a*, 59*b* of the cam followers 16*a*, 16*b* are located near one another. In this case, the cams 33*a*, 33*b* are in their first positions and abut the first respective stop sections 57*a*, 57*b* of the cam follower apertures 46*a*, 46*b*.

By rotating the shaft 38 (in clockwise-direction in the views of FIGS. 1, 11), the cam 33 rotate (in the same direction. The cams 33 and cam followers 16 cooperate with each other, leading to moving of the end parts 59*a*, 59*b* of the followers away from each other as well as out of the panel 1, in the horizontal direction X, providing the movement of the latching members 11 towards their latching positions (see FIGS. 2, 12). Particularly, each cam 33*a*, 33*b* rotates to its second position within the respective aperture 46 of the respective cam follower 16, towards the second stop section 58*a*, 58*b*. Therein, the eccentric part of the cam 33—that abuts the first circle section 54 of the cam follower aperture 46—forces the cam follower 16 outwardly. Herein, the second circle section 55 of the cam follower aperture 46 slides along the respective cam 33, in substantially abutting relation with respect to each other. By rotating the shaft 38 in reverse direction, the cams 33 can be returned to their first positions and the latches 11 can be retracted into the panel 1.

During operation, at each position of the cam 33 with respect to the cam follower 16, relatively large circle sections of the opposite surfaces of the cam and cam follower remain in contact with each other, allowing relatively high loading of these components and providing improved durability. Moreover, as is mentioned above, the present mechanical operating mechanism can be made relatively compact and of a relatively small number components.

FIGS. 13-16 show an alternative embodiment of the operating mechanism, that is also applied in the above assembly embodiments shown in FIGS. 3-7. The embodiment of FIGS. 13-16 differs from the embodiment of FIGS. 9-12 in that the operating mechanism comprises an intermediate cam plate 233, that has been integrally provided with the two cams 33*a*, 33*b*. In this case, the two cams 33*a*, 33*b* extend from a opposite sides of the cam plate 233, parallel to and eccentrically with respect to the rotation axis R. FIGS. 16A, 16B, 16C, 16D, 16E and 16F shown the cam plate 233 in perspective view, a first side view, a top view, a front view, a second side view and a back view, respectively. The operation of the embodiment of FIGS. 13-16 is essentially the same as that of the FIG. 9-12 embodiment, wherein two cam followers 16 can slide along opposite sides of parts of the intermediate cam plate 233, and can cooperate with the cam parts 33*a*, 33*b* of the cam plate 233. For example, the cam plate 233 as such can have substantially the same thickness K (see FIG. 16A) as thicknesses T of the cam parts 33*a*, 33*b* (suitable thicknesses K, T are mentioned above, and can be for example about 1-5 mm, particularly about 2-3 mm). The intermediate cam plate 233 can also be used as part of a locking mechanism, as will be described below (see FIGS. 21-24).

FIGS. 17-20 depict another embodiment 113 of part of an operating mechanism, that is applied for example in the assembly embodiment of FIGS. 8A, 8B. The embodiment is substantially the same as the embodiment of FIGS. 13-16, with a first difference in that the intermediate cam plate 333 comprises first—eccentric—cam parts 133*a*, 133*b* that are separate from concentric second cam parts 133*a*', 133*b*'. FIGS. 20A and 20F show perspective views of the alternative intermediate cam plate 383, and FIGS. 20B, 20C, 20D and 20E show respectively a top view, side view, bottom view and top view of the cam plate 333. The cam plate 333 comprises two first cam parts 133*a*, 133*b*, and two separate second cam parts 133*a*', 113*b*'. The second cam parts 133*a*', 133*b*' are cylindrical cam parts, protruding from opposite surfaces of the plate 333 and having the aperture 149 to receive the operating shaft 38 (as in FIG. 9). In the present embodiment, the respective first cam parts 133*a*, 133*b* are also cylindrical cam parts, protruding from opposite surfaces of the plate 333, and being located eccentrically with respect to the virtual rotation axis R extending through the second cam parts 133*a*', 133*b*' (see FIG. 20). Particularly, the angle $\phi$ included by virtual lines extending between centres of the first cam parts 133*a*, 133*b* on one hand and the rotation axis R on the other hand is larger than 90° in the present embodiment (see FIG. 20D).

Also, the present embodiment comprises respective cam followers 116*a*, 116*b*, each having a first aperture 146*a*, 146*b* to receive a respective first cam part 133*a* 133*b*, and a second aperture 146*a*', 146*b*' to receive and guide a respective second cam part 133*a*', 133*b*'. The first and second apertures of each cam follower are also separate, i.e. spaced-apart, from each other. Each cam follower 116*a*, 116*b* is pivotally coupled to the intermediate cam plate 333 via the respective first cam parts 133*a*, 133*b* and first apertures 146*a*, 146*b*. Each second cam aperture 146*a*', 146*b*' is shaped to guide the respective second cylindrical cam part 183*a*', 133*b*' of the cam plate 333 from a first position—wherein the respective cam part 133*a*', 133*b*' is located against a first stop section 157*a*, 157*b* to a second position—wherein the cam part 133*a*', 133*b*' is located against a second stop section 158*a*, 158*b*. The second apertures 146*a*', 146*b*' (that are partly open at one side, in the present embodiment) are shaped such, particularly concerning the arrangement of the stop faces 157, 158 thereof, that the cam followers 116 can rotate over about 90° with respect to the cam plate 333 during operation, which also leads to limiting the rotation of the operating shaft 58 to about 90°. Also, a major part of each second cam receiving aperture 146*a*', 146*b*' has substantially the shape of a circle section, viewed in front view, to guide the respective second cam part along part of a circular path, the centre of the path coinciding with the centre of the respective first cam aperture 146*a*, 146*b*.

As in the above embodiments, the cam parts 133 and cam followers 116 can be made relatively compact, measured in parallel with the rotation axis R. The operation of the embodiment of FIGS. 17-20 is substantially the same as that of the FIG. 13-16 embodiment, wherein the present embodiment can provide a longer stroke compared to the embodiment of FIG. 13-16, so that the first latches 11*a*, 11*b* can be moved over relatively long vertical distances during operation. Besides, the present embodiment provides a high durability, and compactness.

FIGS. 21-24 show a further embodiment of the operating means, including a lock to lock the operating means when the at least one first latch 11 has been brought to a latching position. For example, the embodiment of FIGS. 21-24 can be used in combination of any of the embodiments of FIGS. 1-20. In the following, the FIGS. 3-7/FIG. 13-16 embodiment of the operating means will be used as an example.

Figure 23:
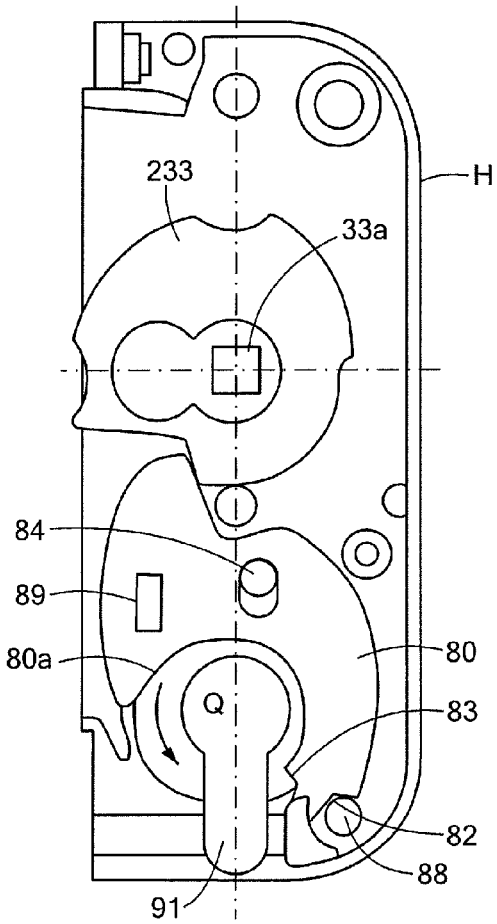
Figure 24:
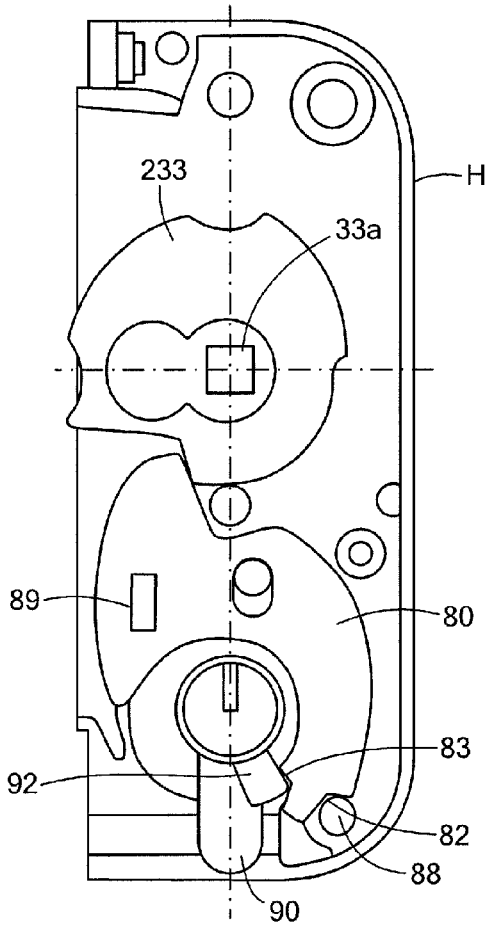

For example, in an embodiment, the locking means can be configured to hold and block the cams 33 of the operating means in their second positions. In the embodiment of FIGS. 21-24, the housing comprises a lock opening 91 to receive a cylinder lock 90 (see FIG. 24) operable by a key (not shown). The cylinder lock 90 is of a generally known type, and comprises a lock member (lock pawl) 92 that can be moved particularly rotated) from an unlocking position (not shown) to the locking position that is shown in FIG. 24, by rotating a rotor part of the lock with the respective key. In the present embodiment, a plate-like blocking member 80 is provided, to cooperate with the lock 90 and intermediate cam plate 233 of the cams 33, to block the cam plate 233.

Figure 21:
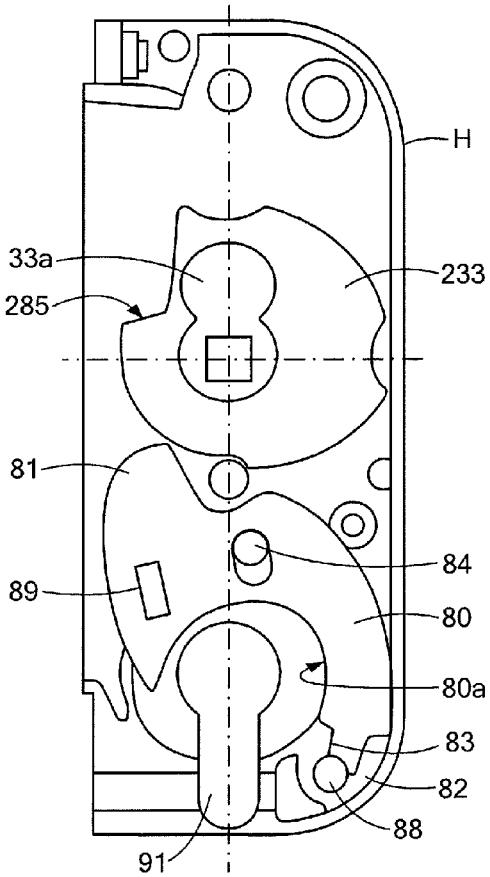

FIG. 21 shows a first step, in which case the lock (not depicted) is in a unlocking position and the blocking plate 80 is in an unblocking position. In that case, the intermediate cam plate 233 can be freely operated, for example by the above-mentioned operating member 30 and shaft 38, to actuate the first latches 11. In FIG. 21, the intermediate cam plate 233 is in a first position with the cams 33*a*, 33*b* in their first positions, so that the first latches 11 are retracted into the panel 1 as in FIG. 3A. Also, a rectangular stop part 89 protruding from a side of the blocking plate 80 and one of the cam followers 16*b* are moved away from each other, in this case (as in FIG. 5).

Figure 22:
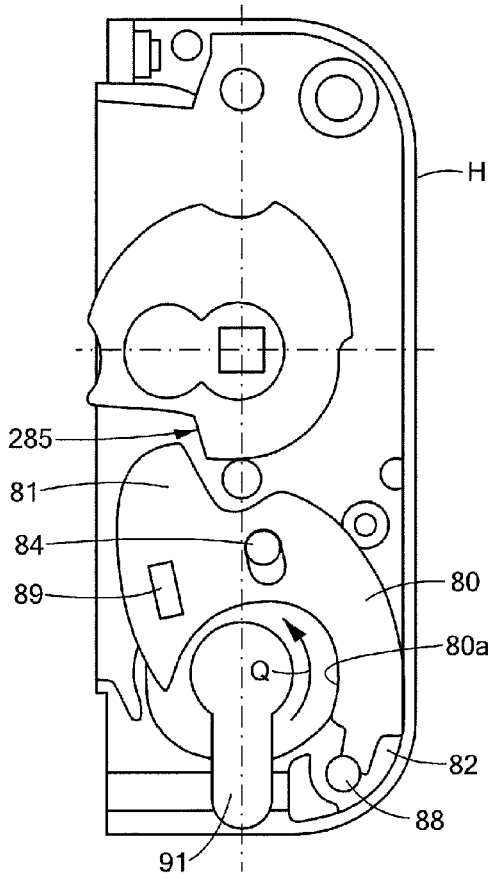

FIG. 22 shows a second step, in which case the intermediate cam plate 233 has been moved to a second position with the cams 33*a*, 33*b* in their second positions, so that the latches 11 will be reach partly out of the panel 1, as in FIG. 3B.

In particular, the blocking plate 80 is pivotally coupled to a pivot axis 84, extending in parallel with a rotation axis of the intermediate cam plate 233. After assembly, the lock 90 extends through an aperture of the blocking plate 80, such that the lock member 92 can cooperate with a concave inner edge 80*a* of the blocking plate 80 to shift that plate 80 to a blocking and unblocking position, in case of operation of the lock 90. The blocking plate 280 comprises a blocking cam 81 for cooperation with the intermediate cam plate 233, and a first blocking notch 82 for cooperation with a fixed blocking part 88 of the housing H. Also, the blocking plate comprises a second blocking notch 83, located near the first blocking notch 82, for cooperation with the lock pawl 92.

The intermediate cam plate 283 of the present embodiment is provided with an outer notch 285 that is moved away from the first blocking cam 81 of the blocking plate 280 when the cam plate 233 is in its first position, as in FIG. 21. The outer notch 285 of the cam plate 233 is located opposite the first blocking cam 81 of the blocking plate 280 when the cam plate 233 is in its second position, as in FIG. 22. In that case, the lock 90 can be operated, by moving the lock pawl along the inner edge 80*a* of the blocking plate 80 to shift that plate 80 to the blocking position as shown in FIGS. 23 and 24. The movement of the pawl is indicated by arrows Q in FIGS. 22 and 23. When the blocking plate 80 is in its blocking position, the blocking cam 81 is held against the notch 285 of the cam plate, so that rotation of the cam plate 233 is prevented. Besides, the lock pawl 92 is held in the second notch of the blocking plate 80 whereas the first notch of the blocking plate has received the fixed blocking part 88 of the housing H, such that movement of the blocking plate 80 is prevented, and the intermediate cam plate 233 is blocked. Also, preferably, the rectangular stop part 89 of the blocking plate 80 abuts a lateral (vertical) side of one of the cam followers 16*b*, as in FIG. 5, to cooperate therewith when the blocking plate 80 is in its blocking position. In this way, forces applied to cam plate 233 for unauthorised/undesired returning the latches 11 to release positions are at least partly transmitted to the blocked blocking plate 80, via the cooperation of the stop part 89 and cam follower 16*b*, abutting each other in the horizontal direction X.

The cam plate 233 can be released by returning the lock pawl 92 in opposite direction, via operation of the lock 90, so that the blocking plate 80 can be returned to the initial position shown in FIGS. 21-22.

It is self-evident that the invention is not limited to the exemplary embodiments described. Various modifications are possible within the framework of the invention as set forth in the following claims.

It is to be understood that in the present application, the term "comprising" does not exclude other elements or steps. Also, each of the terms "a" and "an" does not exclude a plurality. Any reference sign(s) in the claims shall not be construed as limiting the scope of the claims.

As follows from the above embodiments, the assembly can be of a modular type, wherein various components can be assembled or added to the assembly at desired assembly times.

For example, each panel 1 can be designed in different manners and comprise, for instance, a horizontal sliding panel, vertical sliding panel, push panel, swinging panel, swivelling panel, pivot panel, saloon panel, revolving panel, overhead panel, machine doors, emergency exit doors, or the like. The panel can be manufactured from various materials, for example wood, steel of metal and be built up from, for instance, various elements and/or profiles. Besides, the panel 1, or part thereof, can be made of plastic. The same holds for a respective frame 8 or other construction, that abuts the panel or enclosed a respective passageway. Particularly, the present invention can be applied in a simple manner to wooden panels, for example in panels (and frames) that are already assembled and/or mounted in a building or of furniture. Also, the present invention is particularly advantageous to be implemented in double doors and/or fire exits, since various latches can be operated with a single operating means (for example via one manually operating member 30 or the operating shaft 38, or electrically using a motor to rotate the operating shaft 38).

Also, for example, in each embodiment, the operating means can also comprise a housing H (see FIGS. 3A and 20), that can be mounted into the panel 1 to hold parts of the operating means. For example, the housing can be connected to a mentioned first latch receiving profile 19 of the assembly, at a suitable position. The housing H, that can be made for example of a suitable metal, alloy or steel, can comprise suitable apertures to receive parts of the operating means, operating shaft 38 and lock means, and to provide passageways to the cam followers 16.

The invention claimed is:

1. An assembly comprising:

a moveable panel having a direction of movement and that is positionable in a first, closed position with respect to an element and having a first lateral side, the first lateral side being perpendicular to the direction of movement of the moveable panel; and a latching mechanism for latching said panel to said element that includes:

at least one first latch, and operating means that are adapted to move the at least one first latch out of the first lateral side of the panel from a panel-releasing position to a panel-latching position or from a panel-latching position to a panel-releasing position, wherein the operating means comprise:

at least a first cam part that is rotatable with respect to a rotation axis, and that extends parallel or substantially parallel to and eccentrically with respect to the rotation axis;

a respective second cam part having an outer second circle section that is concentric with respect to the rotation axis; and at least one cam follower which is connected to a respective first latch, wherein the at least one cam follower includes a first aperture part that rotatably receives the at least one first cam part, wherein the at least one cam follower also includes a second aperture part having an inner circle section that is configured to be guided along the circle section of the outer contour of the respective second cam part, and wherein a major part of each second aperture part of the at least one cam follower has a same or substantially the same shape of a circle section, viewed in front view, to guide the respective second cam part along part of a circular path, wherein the at least one first latch is dimensioned such that it extends along the entire or substantially the entire first lateral side of the panel.

2. An assembly according to claim 1, wherein the first lateral side of the panel is provided with at least one longitudinal groove that is structured and arranged to receive the at least one first latch when said at least one first latch is in the respective panel-releasing position, and wherein said at least one longitudinal groove has a latch receiving profile.

3. An assembly according to claim 1, wherein the latching mechanism further includes:

guiding means to guide each first latch of the at least one first latch from the panel-releasing position to the panel-latching position or from the panel-latching position to the panel-releasing position, wherein the guiding means are structured and arranged to guide an end part of each first latch towards the panel-latching position at which the end part of each first latch extends in a first direction that is perpendicular or substantially perpendicular to the first lateral side of the panel and extends in a second direction that is, parallel or substantially parallel to the first lateral side of the panel.

4. An assembly according to claim 1, wherein the at least one first latch of the latching mechanism includes two first latches that are each aligned along the first lateral side of the panel each having a length, and that are moveable by the operating means over a certain distance away from each other, in a direction parallel or substantially parallel to the first lateral side of the panel, wherein the combined lengths of the two first latches are equal to or substantially equal to the length of the first lateral side of the panel.

5. The assembly according to claim 4, wherein the two first latches are aligned with respect to each other, one latch above the other latch, and are movable over a certain distance away from each other, in a direction parallel to the first lateral side of the panel, by operating means when said two first latches are moved to the latching positions, wherein an overall length of said two first latches is at least half of a length of said first lateral side.

6. The assembly according to claim 5, wherein the overall length of said two first latches is approximately 80 percent of the length of said first lateral side.

7. The assembly according to claim 5, wherein the overall length of said two first latches is approximately the same length of said first lateral side.

8. The assembly according to claim 1, wherein the operating means comprise two cams and two respective cam followers to operate each of the two first latches, wherein the operating means further includes an intermediate cam plate being rotatable with respect to the rotation axis, the two cams extending from opposite sides of the cam plate, parallel to or substantially parallel to and eccentrically with respect to the rotation axis, and parts of the cam followers are structured and arranged in slidable contact with the opposite sides of the intermediate cam plate, wherein centers of the first circle sections of the outer contours of the cams are located off-line with respect to each other when viewed in a direction parallel to the rotation axis.

9. The assembly according to claim 8, wherein the outer contour of each cam of the two cams includes a second circle section that is concentric with respect to the rotation axis, wherein the inner contour of the aperture of the corresponding translatable cam follower has a second circle section that is configured to be guided along the second circle section of the outer contour of the corresponding cam upon rotation of the cam, wherein preferably a virtual center of the second circle section of the inner contour of the aperture of the translatable cam follower coincides with the virtual center of the first circle section of the outer contour of the cam, wherein more preferably each cam has an outer contour being substantially 8-shaped and the aperture of the cam follower is configured to snugly hold the 8-shaped cam in a longitudinal direction of the 8 such that the 8-shaped cam can still rotate in the aperture.

10. An assembly according to claim 1, wherein the latching mechanism is structured and arranged to create, when in a panel-latching position, a latching state with at least one nearby element having a latching aperture to receive the at least one first latch when said at least one first latch is in the panel-latching position and the first panel is in its first position, wherein the at least one nearby element comprises at least one of:

a frame or framework, or part thereof; and a second moveable panel arranged with a lateral side opposite the first lateral side of the first moveable panel when the panels are disposed in respective first positions.

11. An assembly according to claim 1, wherein the at least one first latch of the latching mechanism includes two first latches, the two first latches at least partly overlapping each other when viewed in a direction perpendicular to said first lateral panel side, and wherein the two first latches are moveable in opposite directions with respect to each other and are movable out of the first lateral side of the panel, towards their panel-latching positions.

12. An assembly according to claim 1, wherein each first latch of the at least one first latch includes an elongated metal or steel bar having a length of at least one-half of the length of a respective lateral side of the panel, a width measured perpendicularly to a respective lateral side of the panel of at least 2 cm, and a thickness of at least 5 mm.

13. An assembly comprising:

a moveable panel having a direction of movement and that is positionable in a first, closed position with respect to an element and having a first lateral side, the first lateral side being perpendicular to the direction of movement of the moveable panel; and a latching mechanism for latching said panel to said element that includes:

at least one first latch that is dimensioned such that it extends along the entire or substantially the entire first lateral side of the panel; and operating means that are adapted to move the at least one first latch out of the first lateral side of the panel from a panel-releasing position to a panel-latching position or from a panel-latching position to panel-releasing position, wherein the operating means comprise:

at least one cam being rotatable with respect to a rotation axis between a first and a second position, wherein the cam has an outer contour that has a first circle section, a virtual center of the first circle section being located eccentrically with respect to the rotation axis; and at least one translatable cam follower which is connected to a respective first latch of the at least one first latch, wherein the cam follower includes an aperture having an inner contour with a first circle section that rotatably receives the first circle section of the outer contour of the cam, and is adapted to move the latch between the panel-releasing position and the panel-latching position upon rotation of the first cam between the first and second position, respectively, wherein the outer contour of the cam includes a second circle section that is concentric with respect to the rotation axis, wherein the inner contour of the aperture of the at least one translatable cam follower has a second circle section that is configured to be guided along the second circle section of the outer contour of cam upon rotation of the cam, wherein a virtual center of the second circle section of the inner contour of the aperture of the at least one translatable cam follower coincides with the virtual center of the first circle section of the outer contour of the cam, and wherein said cam has an outer contour being substantially 8-shaped and the aperture of the at least one cam follower is configured to snugly hold the 8-shaped cam in a longitudinal direction of the 8-shaped cam such that the 8-shaped cam can still rotate in the aperture.

14. A latching mechanism comprising means for latching a panel to at least one nearby element in case the panel is in a first, closed or substantially closed position, the latching means including:

at least one first latch, and operating means for moving the at least one first latch out of a first lateral side of the panel from a panel-releasing position to a panel-latching position and from a panel-latching position to a panel-releasing position, wherein the operating means comprise:

at least a first cam part that is rotatable with respect to a rotation axis, and that extends parallel or substantially parallel to and eccentrically with respect to the rotation axis;

a respective second cam part having an outer second circle section that is concentric with respect to the rotation axis; and at least one cam follower which is connected to a respective first latch, wherein the at least one cam follower includes a first aperture part that rotatably receives the at least one first cam part, wherein the at least one cam follower also includes a second aperture part having an inner circle section that is configured to be guided along the circle section of the outer contour of the respective second cam part, and wherein a major part of each second aperture part of the at least one cam follower has a same or substantially the same shape of a circle section, viewed in front view, to guide the respective second cam part along part of a circular path;

wherein each first latch of the at least one first latch is dimensioned such that it extends along or substantially along the entire first lateral side of the panel.

15. An assembly comprising:

at least one element that includes least one of:

a frame or framework, or part thereof, and a first moveable panel arranged with a first lateral side;

a second moveable panel having a second lateral side and positionable in a first, closed position with respect to the first lateral side of the first moveable panel of the element, wherein the first lateral side of the first moveable panel is disposed opposite and parallel to or substantially parallel to the second lateral side of the second moveable panel when the panels are disposed in respective first positions; and a latching mechanism for latching said second moveable panel to the first moveable panel of the at least one element to create, when in a panel-latching position, a latching state with said at least one element, and including:

at least one first latch, operating means that are adapted to move the at least one first latch out of the second lateral side of the second moveable panel from a panel-releasing position to a panel-latching position or from a panel-latching position to a panel-releasing position, wherein the operating means comprise:

at least a first cam part that is rotatable with respect to a rotation axis, and that extends parallel or substantially parallel to and eccentrically with respect to the rotation axis;

a respective second cam part having an outer second circle section that is concentric with respect to the rotation axis; and at least one cam follower which is connected to a respective first latch, wherein the at least one cam follower includes a first aperture part that rotatably receives the at least one first cam part, wherein the at least one cam follower also includes a second aperture part having an inner circle section that is configured to be guided along the circle section of the outer contour of the respective second cam part, and wherein a major part of each second aperture part of the at least one cam follower has a same or substantially the same shape of a circle section, viewed in front view, to guide the respective second cam part along part of a circular path; and a latching aperture to receive the at least one first latch when said at least one first latch is in the panel-latching position and the second moveable panel is in a first position, wherein the at least one first latch is dimensioned such that it extends along the entire or substantially the entire second lateral side of the second moveable panel.

* * * * *

UNITED STATES PATENT AND TRADEMARK OFFICE

CERTIFICATE OF CORRECTION

PATENT NO. : 8,231,148 B2
APPLICATION NO. : 11/985060
DATED : July 31, 2012
INVENTOR(S) : Johannes Jacob Hans Willem van der Kooij It is certified that error appears in the above-identified patent and that said Letters Patent is hereby corrected as shown below:

In the Specification

Column 12, line 62, "2113'" should read --21B'--;

Column 12, line 66, "2113'" should read --21B'--;

Column 16, line 32, "383" should read --333--;

Column 16, line 59, "183a'" should read --133a'--; and

Column 18, line 1, "283" should read --233--.

Signed and Sealed this
Fifth Day of August, 2014

Michelle K. Lee

Michelle K. Lee
*Deputy Director of the United States Patent and Trademark Office*